US011769950B2

(12) United States Patent
Matsumoto et al.

(10) Patent No.: US 11,769,950 B2
(45) Date of Patent: Sep. 26, 2023

(54) WIRELESS COMMUNICATION DEVICE

(71) Applicant: DENSO CORPORATION, Kariya (JP)

(72) Inventors: Sho Matsumoto, Kariya (JP); Jungaun Lee, Kariya (JP); Youichi Hayase, Kariya (JP); Ryu Atsuta, Kariya (JP)

(73) Assignee: DENSO CORPORATION, Kariya (JP)

( * ) Notice: Subject to any disclaimer, the term of this patent is extended or adjusted under 35 U.S.C. 154(b) by 23 days.

(21) Appl. No.: 17/555,574

(22) Filed: Dec. 20, 2021

(65) Prior Publication Data

US 2022/0263245 A1 Aug. 18, 2022

(30) Foreign Application Priority Data

Feb. 15, 2021 (JP) ..... 2021-021883

(51) Int. Cl.
*H01Q 9/04* (2006.01)

(52) U.S. Cl.
CPC ..... *H01Q 9/0421* (2013.01); *H01Q 9/045* (2013.01); *H01Q 9/0442* (2013.01)

(58) Field of Classification Search
CPC ..... H01Q 9/0421; H01Q 9/0442; H01Q 9/045
See application file for complete search history.

(56) References Cited

U.S. PATENT DOCUMENTS

2013/0225102 A1* 8/2013 Tsutsumi ..... H01Q 23/00 257/E31.11
2019/0229411 A1 7/2019 Sugimoto et al.
2021/0280966 A1 9/2021 Lee et al.

FOREIGN PATENT DOCUMENTS

JP 2012175422 A * 9/2012
JP 2016-181755 A 10/2016

* cited by examiner

*Primary Examiner* — Dieu Hien T Duong
(74) *Attorney, Agent, or Firm* — POSZ LAW GROUP, PLC

(57) ABSTRACT

A wireless communication device includes: a substrate containing a dielectric; a zeroth-order resonance antenna; a high frequency circuit mounted on the substrate and a metal body mounted on the substrate. The zeroth-order resonance antenna includes: a main plate providing a ground potential, a patch portion, a feeder line extending from a feeding point to the patch portion to electrically connect the patch portion and the high frequency circuit, at least a part thereof being arranged on a same surface as the patch portion on the substrate, and a short circuit portion. The metal body has a same potential as the main plate. The metal body has a longer length (greater height) than the patch portion in a Z direction.

13 Claims, 19 Drawing Sheets

WIRELESS COMMUNICATION DEVICE

CROSS REFERENCE TO RELATED APPLICATION

The present application is based on and claims the benefit of priority of Japanese Patent Application No. 2021-021883, filed on Feb. 15, 2021, the disclosure of which is incorporated herein by reference.

TECHNICAL FIELD

The present disclosure generally relates to a wireless communication device.

BACKGROUND

A device including a zeroth-order resonance antenna has a structure in which a main plate, or a ground plate, and a patch portion facing each other are connected by a short circuit portion.

SUMMARY

It is an object of the present disclosure to provide a wireless communication device having a desired directivity.

The objects, features, and advantages disclosed in this specification will become apparent by referring to following detailed descriptions and accompanying drawings.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
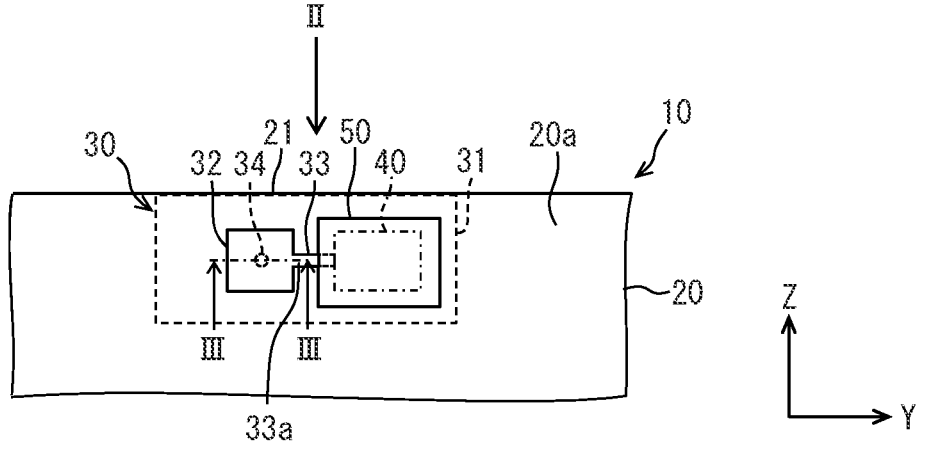
FIG. 1 is a plan view showing a schematic configuration of a wireless communication device according to a first embodiment.

Hereinafter, multiple embodiments are described with reference to the drawings. The same reference numerals are assigned to the corresponding elements in each embodiment, and thus, duplicate descriptions may be omitted. In each of the embodiments, when only a part of the configuration is described, the other parts of such configuration may be borrowed from the other, preceding embodiments. Further, not only the combinations of the configurations explicitly shown in the description of the respective embodiments, but also the configurations of the multiple embodiments can be partially combined even when they are not explicitly shown, as long as there is no difficulty in the combination of the multiple embodiments in particular.

First Embodiment

First, a schematic configuration of a wireless communication device is described. The wireless communication device of the present embodiment is configured to transmit and/or receive radio waves having a predetermined operating frequency. The wireless communication device is configured to be able to transmit and/or receive radio waves in a frequency band used in short-range wireless communication (NFC). The operating frequency in the present embodiment is 2.44 GHz. The operating frequency may be appropriately designed and may be another frequency (for example, 5 GHz). The wireless communication device is used, for example, for communication between devices mounted on a vehicle.

<Wireless Communication Device>

Figure 2:
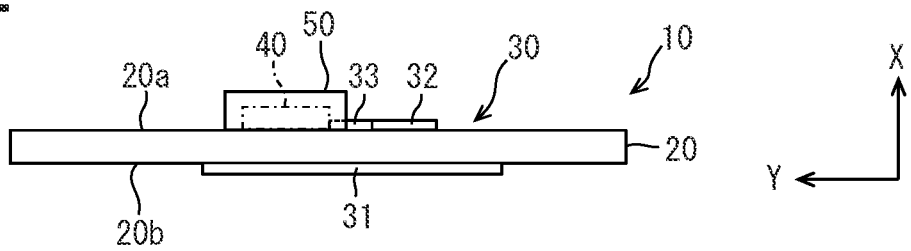
FIG. 2 is a side view of FIG. 1 as seen from a II direction.
Figure 3:
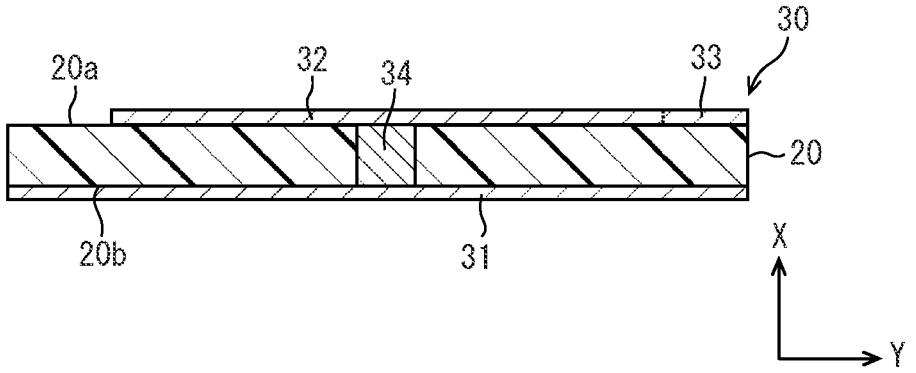
FIG. 3 is a cross-sectional view taken along a line III-III of FIG. 1.
Figure 4:
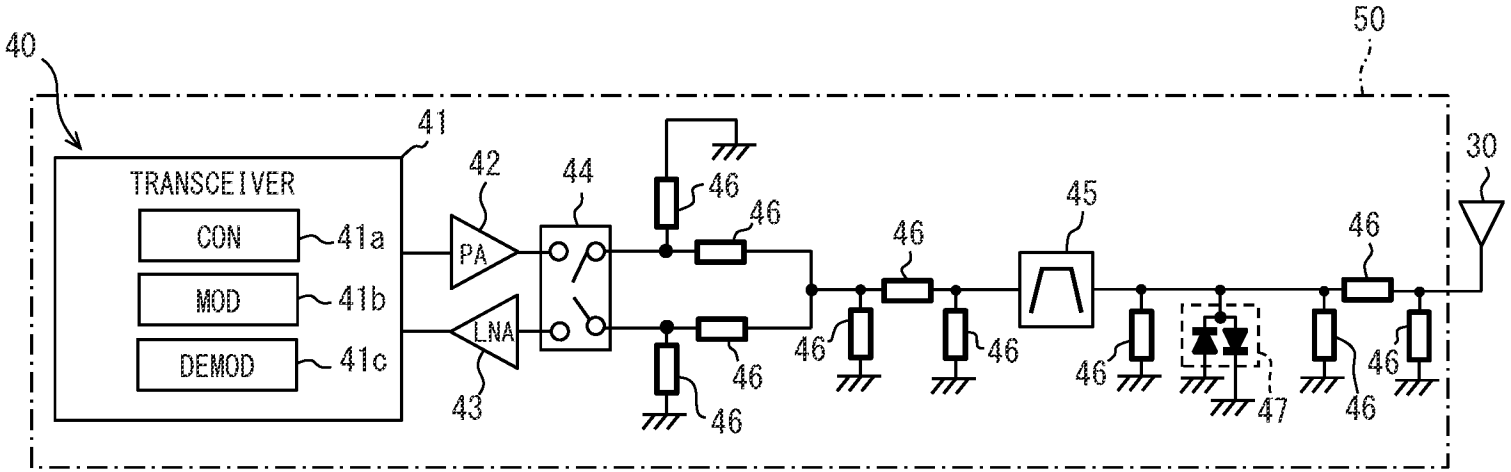
FIG. 4 is a circuit diagram showing a high frequency circuit.

FIG. 1 is a plan view showing a wireless communication device. FIG. 2 is a side view of FIG. 1 as seen from a II direction. FIG. 3 is a cross-sectional view taken along a line III-III of FIG. 1. FIG. 4 is a circuit diagram showing an example of a high frequency circuit.

As shown in FIGS. 1, 2, and 3, a wireless communication device 10 includes a substrate 20, a zeroth-order resonance antenna 30, a high frequency circuit 40, and a metal body 50. The wireless communication device 10 includes an antenna device including the zeroth-order resonance antenna 30 and the metal body 50, and the high frequency circuit 40.

In the following, the thickness (plate thickness) direction of the substrate 20 is the X direction, and one direction orthogonal to the X direction is the Y direction. A direction orthogonal to the X direction and the Y direction is defined as the Z direction. Unless otherwise specified, a shape in a plane seen from the X direction, that is, a shape along the YZ plane defined by the Y direction and the Z direction is referred to as a plane shape. In other words, using standard naming for layered devices: (i) the X direction in FIG. 2 is a vertical direction corresponding to height, (ii) the view in FIG. 1 is a plan view (viewed in the negative X direction), and (iii) the YZ plane is a horizontal plane.

The substrate 20 is an insulating base material (i.e. insulating portion) of a printed circuit board. The substrate 20 is made of a dielectric material such as resin. By using the substrate 20, a wavelength shortening effect by the dielectric material can be expected. As the substrate 20, for example, a member made only of resin, or a combination of resin and glass cloth, non-woven fabric, or the like can be adopted. The substrate 20 functions as a holding portion that holds a main plate 31 and a patch portion 32 in a predetermined positional relationship.

The substrate 20 has a one surface (a top surface) 20*a* and a back surface (a bottom surface) 20*b* that is opposite to the one surface 20*a* in the X direction. In the present embodiment, the patch portion 32 and a feeder line 33 are arranged on the one surface 20*a* of the substrate 20, and the main plate 31 is arranged on the back surface 20*b*. In such a configuration, a facing distance (separation distance or spacing distance) between the main plate 31 and the patch portion 32 and a thickness (or height) of a short circuit portion 34 in the X direction can be adjusted by adjusting the thickness of the substrate 20. The substrate 20 may have a single-layer structure or a multi-layer structure.

The zeroth-order resonance antenna 30 includes the main plate 31, the patch portion 32, the feeder line 33, and the short circuit portion 34. The main plate 31, the patch portion 32, the feeder line 33, and the short circuit portion 34 are conductor elements (conductor portions) of the printed circuit board. That is, the zeroth-order resonance antenna 30 is configured on a printed circuit board. The zeroth-order resonance antenna 30 is mounted/implemented on the substrate 20. The printed circuit board includes conductor elements other than the components of the zeroth-order resonance antenna 30.

As shown in FIG. 1, the zeroth-order resonance antenna 30 of the present embodiment is provided in the vicinity of an end portion 21 of the substrate 20 in the Z direction. The end portion 21 is one of the end portions of the substrate 20 in the Z direction. The patch portion 32 is unevenly arranged on one side close to the end portion 21 of the end portions of the substrate 20 in the Z direction. The end portion 21 is one of four sides of the substrate 20 having a rectangular plane shape. The end portion 21 is one side substantially parallel to the Y direction. The end portion 21 is one side closest to the zeroth-order resonance antenna 30 among the four sides of the substrate 20. The end portion 21 corresponds to an outer peripheral edge of the substrate 20.

The main plate 31 provides a ground potential for the zeroth-order resonance antenna 30. The main plate 31 is electrically connected to a ground pattern (not shown) that supplies a ground potential on the printed circuit board. The main plate 31 is a conductor made of copper or the like. The direction perpendicular to a plate surface of the main plate 31 is substantially parallel to the X direction. In a plan view, an area size of the main plate 31 is larger than an area size of the patch portion 32. The main plate 31 has a size that includes/encompasses the entire patch portion 32. The main plate 31 preferably has a size required for stable operation of the zeroth-order resonance antenna 30.

The main plate 31 of the present embodiment has a substantially rectangular plane. Each side of the main plate 31 has a length of, for example, one or more times the wavelength of the radio wave of the operating frequency, that is, one wavelength or more. The main plate 31 is arranged on the back surface 20*b* of the substrate 20 as described above. The main plate 31 is formed by patterning a metal foil, for example, a copper foil, which is arranged on the back surface 20*b* of the substrate 20. The main plate 31 is a part of a surface layer pattern on a back surface 20*b* side of the printed circuit board.

The plane shape of the main plate 31 can be changed as appropriate. In the present embodiment, the plane shape of the main plate 31 is rectangular as an example, but other configurations may be square or other polygonal shapes. Further, the planar shape of the main plate 31 may be circular (including an ellipse). The main plate 31 is preferably formed to have a diameter larger than a circle having one wavelength. The main plate 31 is not limited to a back surface arrangement of the substrate 20. For example, it may be arranged inside the substrate 20 as a part of an inner layer conductor.

The patch portion 32 is a conductor made of copper or the like. The patch portion 32 is a conductor arranged to face the main plate 31 with a predetermined distance (separation distance) from the main plate 31 in the X direction. The patch portion 32 may sometimes be referred to as a radiating element. In a plan view, the entire patch portion 32 overlaps with the main plate 31. That is, the entire plate surface (i.e., a lower surface) of the patch portion 32 faces the main plate 31 in the X direction. The patch portion 32 is arranged substantially parallel to the main plate 31. Substantially parallel is not limited to perfect parallelism. For example, the patch portion 32 may be tilted by several degrees to ten degrees with respect to the main plate 31.

The patch portion 32 of the present embodiment is arranged on the one surface 20*a* of the substrate 20 as described above. The patch portion 32 is formed by patterning a metal foil arranged on the one surface 20*a* of the substrate 20. The patch portion 32 is a part of the surface layer pattern on a one surface 20*a* side of the printed circuit board. The surface layer pattern is a pattern arranged on a surface (i.e., the one surface 20*a* or the back surface 20*b*) of the substrate 20 among the conductor patterns arranged in multiple layers on the printed circuit board. The basic shape of the patch portion 32 is a substantially square plane. The basic shape means an outline of the patch portion 32 in a plan view. The patch portion 32 may have a slit that opens in the outline. For example, it is also possible to employ a patch portion 32 having a substantially H-shaped plane, in which two slits are provided in a substantially square plane. The patch portion 32 is not limited to a one-surface arrangement of the substrate 20. For example, it may be arranged inside the substrate 20 as a part of an inner layer conductor.

By arranging the patch portion 32 to face the main plate 31, a capacitor is formed according to the area size of the patch portion 32 and the distance from the main plate 31. The patch portion 32 is sized to form a capacitor that resonates in parallel with an inductor included in the short circuit portion 34 at a target frequency. The area size of the patch portion 32 is appropriately designed to provide a desired capacitor and thus to operate at a desired operating frequency.

In the present embodiment, the basic shape (i.e., outline) of the patch portion 32 is square as an example, but as other configurations, the plane shape of the patch portion 32 may be circular, regular octagon, regular hexagon, or the like. The basic shape of the patch portion 32 is preferably a line-symmetrical shape with each of the two straight lines orthogonal to each other as the axis of symmetry, that is, a bi-directional line-symmetrical shape. The bi-directional line symmetrical shape refers to a figure that is line-symmetric with a first straight line as an axis of symmetry, and that is also line-symmetric with respect to a second straight line that is orthogonal to the first straight line. The bi-directional line symmetrical shape corresponds to, for example, an ellipse, a rectangle, a circle, a square, a regular hexagon, a regular octagon, a rhombus, or the like. Further, the patch portion 32 may more preferably be a point-symmetrical figure such as a circle, a square, a rectangle, or a parallelogram.

The feeder line 33 is a conductor for supplying electric power to the patch portion 32. The feeder line 33 extends from a feeding point to the patch portion 32, and at least a part of the feeder line 33 is arranged on the same surface as the patch portion 32 on the substrate 20. The feeder line 33 arranged on the same surface as the patch portion 32 may sometimes be referred to as a microstrip line. One of the ends of the feeder line 33 is electrically connected to an edge of the patch portion 32. The other end of the feeder line 33 is electrically connected to the high frequency circuit 40. A connection portion between the feeder line 33 and the patch portion 32 corresponds to a feeding point. The electric current input to the feeder line 33 via the high frequency circuit 40 propagates to the patch portion 32 and excites the patch portion 32. Note that the power supply method is not limited to the direct power supply method. A feeding method in which the feeding line 33 and the patch portion 32 are electromagnetically coupled may be adopted.

The feeder line 33 of the present embodiment includes a conductor arranged on the one surface 20*a* of the substrate 20. That is, at least a part of the feeder line 33 is also a part of the surface layer pattern on the one surface 20*a* side of the printed circuit board. The feeder line 33 is also formed by patterning a metal foil arranged on the one surface 20*a* of the substrate 20. In the feeder line 33, at least a part of the line 33 extending from the feeding point is integrally formed with the patch portion 32. In the examples shown in FIGS. 1 to 3, the feeder line 33 extends from a non-opposing side of the patch portion 32, not extending from an opposing side to the end portion 21 of the substrate 20. The feeder line 33 extends from a side adjacent to the opposing side. The side having the feeding point is called a feeding side. One of the sides adjacent to the opposing side is the feeding side. The opposing sides are sides substantially parallel to the Y direction. The side adjacent to the opposing side including the feeding side is a side substantially parallel to the Z direction. The feeder line 33 is connected to a substantially central portion of the feeding side of the patch portion 32.

The feeder line 33 has a straight portion 33*a* extending in a straight line shape as at least a part extending from the feeding point. The straight portion 33*a* extends in a straight line shape from the feeding point along a virtual straight line connecting the substantial center of the patch portion 32 and the feeding point, for example. In the examples shown in FIGS. 1 to 3, the straight portion 33*a* extends in the Y direction. The feeder line 33 is arranged to face the main plate 31 in the X direction. The feeder line 33 of the present embodiment is composed only of a conductor arranged on the one surface 20*a*.

The feeder line 33 may be configured to include only the straight portion 33*a*. In such case, the entire feeder line 33 forms a straight line shape. The feeder line 33 may have a bent portion. The feeder line 33 may include a portion extending in the Y direction and a portion extending in the Z direction. The feeder line 33 may include a portion having a Y-direction component and a Z-direction component. The feeder line 33 may include a curved portion. The feeder line 33 may include a via conductor and an inner layer conductor in addition to the conductor arranged on the one surface 20*a*.

The short circuit portion 34 electrically connects the main plate 31 and the patch portion 32, that is, short-circuits the two. The short circuit portion 34 is a columnar conductor arranged on the substrate 20. One of the ends of the short circuit portion 34 is connected to the main plate 31, and the other end is connected to the patch portion 32. The short circuit portion 34 has, for example, a substantially circular plane shape. By adjusting a diameter and/or a length of the short circuit portion 34, a value of the inductor (i.e., inductance) in the short circuit portion 34 can be adjusted. The short circuit portion 34 is connected to the substantial center of the patch portion 32 in a plan view. The center of the patch portion 32 corresponds to the center of gravity of the patch portion 32.

When the patch portion 32 has a substantially square plane shape, the center corresponds to the intersection of the two diagonal lines of the patch portion 32. The short circuit portion 34 is a via conductor in which a conductor is arranged in a through hole (so-called via) formed in the substrate 20. The through hole penetrates the substrate 20 from the one surface 20*a* to the back surface 20*b*. The number of via conductors constituting the short circuit portion 34 is not particularly limited. In the present embodiment, one via conductor constitutes the short circuit portion 34. The short circuit portion 34 may be formed by a plurality of via conductors arranged in parallel between the main plate 31 and the patch portion 32.

The high frequency circuit 40 is electrically connected to the zeroth-order resonance antenna 30 and forms at least a part of a wireless communication circuit that wirelessly communicates with the outside via the zeroth-order resonance antenna 30. The high frequency circuit 40 is mounted on a substrate 20 (i.e., on the printed circuit board). In the present embodiment, the high frequency circuit 40 is mounted on the one surface 20*a* of the substrate 20. The high frequency circuit 40 is provided as, for example, an IC chip, and is solder-bonded to a surface layer pattern (i.e., a land, not shown) of the printed circuit board. The high frequency circuit 40 may be arranged inside the substrate 20 (i.e., in the printed circuit board). If it is a multilayer substrate, the high frequency circuit 40 can be provided as a built-in component. The high frequency circuit 40 and the patch portion 32 are arranged side by side in the Y direction.

The high frequency circuit 40 has at least a transmission function of modulating and transmitting a transmission signal and/or a reception function of demodulating a reception signal. The high frequency circuit 40 may be referred to as a transmission circuit when it has a transmission function, a reception circuit when it has a reception function, and a transmission/reception circuit when it has a transmission/reception function. Further, the high frequency circuit 40 may be referred to as a wireless circuit, an RF circuit, a power feeding circuit, or the like.

As shown in FIG. 4, the high frequency circuit 40 of the present embodiment includes a transceiver 41, a power amplifier (PA) 42, a low noise amplifier (LNA) 43, a switch 44, and a bandpass filter 45. The transceiver 41 has a converter (CON) 41*a*, a modulator (MOD) 41*b*, and a demodulator (DEMOD) 41*c*. The high frequency circuit 40 has a so-called RF unit.

The converter 41*a* performs analog-to-digital conversion of a signal. At the time of transmission, the converter 41*a* converts a baseband signal (i.e., a digital signal) into an analog signal. The modulator 41*b* modulates the converted analog signal. The transceiver 41 oscillates the modulated signal at a frequency of an RF signal. The demodulator 41*c* demodulates the reception signal. The converter 41*a* converts the demodulated signal (analog) into a digital signal (baseband signal). RF is an abbreviation for radio frequency.

A power amplifier 42 amplifies the power of the RF signal and outputs it to the switch 44. The low noise amplifier 43 amplifies the reception signal that is input via the switch 44 and outputs it to the transceiver 41. The switch 44 switches a power supply line either to a transmission side or a reception side. The switch 44 may sometimes be referred to as an antenna switch. The power amplifier 42 is provided between the switch 44 and the transceiver 41 in the power supply line on the transmission side. The low noise amplifier 43 is provided between the switch 44 and the transceiver 41 in the power supply line on the reception side.

The bandpass filter 45 removes unnecessary frequency components. The bandpass filter 45 is provided between the switch 44 and the zeroth-order resonance antenna 30 in the feeding line. The high frequency circuit 40 further includes a plurality of matching elements 46 constituting a matching circuit for impedance matching, and a protective diode 47. In FIG. 4, for convenience, a common reference numeral is given to the plurality of matching elements 46.

The high frequency circuit 40 shown in FIG. 4 is merely an example. The transmission method and the reception method thereof are not particularly limited. As described above, the high frequency circuit 40 may have only an RF unit, or may have an RF unit and a baseband portion.

The metal body 50 adjusts the directivity by reflecting a part of the radio waves radiated from the zeroth-order resonance antenna 30. The metal body 50 is mounted on the substrate 20 (i.e., on the printed circuit board). The metal body 50 is an element different from the element of the printed circuit board. The metal body 50 has the same potential as the main plate 31, that is, the ground potential. For example, the metal body 50 may have the same potential as the main plate 31 by being connected to the main plate 31 via a conductor element of the printed circuit board. The metal body 50 may have the same potential as the main plate 31 by being electrically connected to the main plate 31 via the ground pattern. The metal body 50 is taller than the patch portion 32 in the X direction. That is, the height of the metal body 50 is longer than the thickness of the patch portion 32. Since the metal body 50 is longer than the patch portion 32, it effectively reflects radio waves. The arrangement of the metal body 50 is described later.

As the metal body 50, for example, a metal block, a metal case for protecting electronic components mounted on a printed circuit board, and a metal portion such as a terminal provided in a connector can be adopted. In the present embodiment, as the metal body 50, a shield case that protects the high frequency circuit 40 from electromagnetic waves is adopted. The metal body 50 is mounted on the one surface 20*a* of the substrate 20. Although not shown, the printed circuit board has a protective film such as a solder resist on the one surface 20*a*. The metal body 50 is solder-bonded to a land (not shown) which is a conductor element exposed from the protective film. The land is electrically connected to the ground pattern. The metal body 50 (i.e., the shield case) is arranged on the protective film. The metal body 50 projects/rises upward from the patch portion 32 on the one surface 20*a*.

The shield case as the metal body 50 has, for example, a box shape with one side opened. The high frequency circuit 40 is housed inside the metal body 50. In the present embodiment, as shown by a one-dot chain line in FIG. 4, all the elements of the high frequency circuit 40 are arranged inside the metal body 50. A part of the elements constituting the high frequency circuit 40 may be arranged inside the metal body 50 (i.e., in the shield case), and the other part may be arranged outside the metal body 50. The metal body 50 may be provided as a mold component together with the high frequency circuit 40. The metal body 50 may be arranged inside the substrate 20 (i.e., in the printed circuit board). If it is a multilayer substrate, the metal body 50 can be provided as a built-in component.

<Operation of Zeroth-Order Resonance Antenna>

Next, the operation of the zeroth-order resonance antenna 30 is described. As described above, the zeroth-order resonance antenna 30 has a structure in which the main plate 31 and the patch portion 32 facing each other are connected by the short circuit portion 34. Such a structure is a so-called mushroom structure, which is the same as a basic structure of metamaterials. Since the zeroth-order resonance antenna 30 is an antenna to which the metamaterial technology is applied, it is sometimes called a metamaterial antenna.

The zeroth-order resonance antenna 30 is designed to operate in a zeroth-order resonant mode at a desired operating frequency. Among the dispersion characteristics of metamaterials, a phenomenon of resonance at a frequency at which a phase constant $\beta$ becomes zero (0) is the zeroth-order resonance. The phase constant $\beta$ is an imaginary part of a propagation coefficient $\gamma$ of a wave propagating on a transmission line. The zeroth-order resonance antenna 30 can satisfactorily transmit and/or receive radio waves in a predetermined band including the frequency at which the zeroth-order resonance occurs.

The zeroth-order resonance antenna 30 is generally operated by LC parallel resonance between a capacitor formed between the main plate 31 and the patch portion 32 and an inductor included in the short circuit portion 34. In the zeroth-order resonance antenna 30, the patch portion 32 is short-circuited to the main plate 31 by the short circuit portion 34 provided in the central region of the patch portion 32. Further, the area size of the patch portion 32 is an area size for forming a capacitor that enables parallel resonance with the inductor included in the short circuit portion 34 at a desired frequency (i.e., at an operating frequency). Note that the value of the inductor (i.e., inductance) is determined according to the dimensions of each part of the short circuit portion 34, that is, for example, the diameter and the length in the Z direction.

Therefore, when electric power of the operating frequency is supplied, parallel resonance occurs due to energy exchange between the inductor and the capacitor, and a vertical electric field is generated at a position between the main plate 31 and the patch portion 32 perpendicular to the main plate 31 (and to the patch portion 32). That is, an electric field in the X direction is generated. Such a vertical electric field propagates from the short circuit portion 34 toward the edge of the patch portion 32, becomes vertically polarized at the edge of the patch portion 32, and propagates in space. Note that the vertically polarized wave here refers to a radio wave in which the vibration direction of the electric field is perpendicular to the main plate 31 and the patch portion 32. Further, the zeroth-order resonance antenna 30 receives the vertically polarized wave coming from the outside of the zeroth-order resonance antenna 30 by the LC parallel resonance.

Note that the resonance frequency of the zeroth-order resonance does not depend on the antenna size. Therefore, the length of one side of the patch portion 32 can be made shorter than the ½ wavelength of the zeroth-order resonance frequency. For example, even if one side has a length equivalent to a one-quarter wavelength, zeroth-order resonance can be generated. For example, when the operating frequency is 2.44 GHz, a wavelength λε is obtained as a square root of (300 [mm/s]/2.44 [GHz])/a dielectric constant of the substrate 20 in a configuration including the substrate 20. It is possible to make one side shorter than a one-quarter wavelength. However, for instance, the gain such as antenna gain is reduced in such a configuration.

<Extension Direction and Directivity of Feeder Line>

Figure 5:
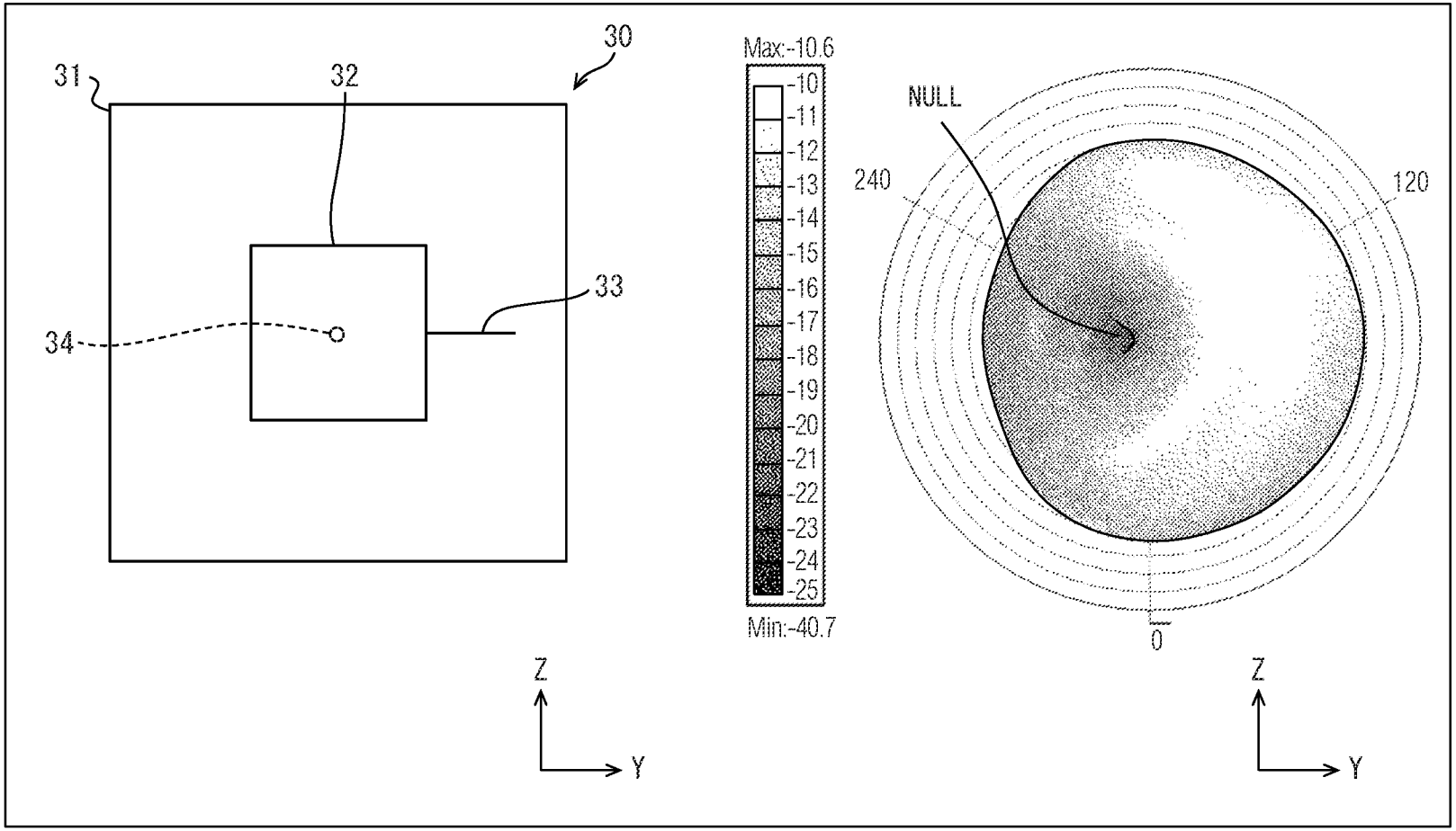
FIG. 5 is a diagram showing radiation characteristics of a zeroth-order resonance antenna.
Figure 6:
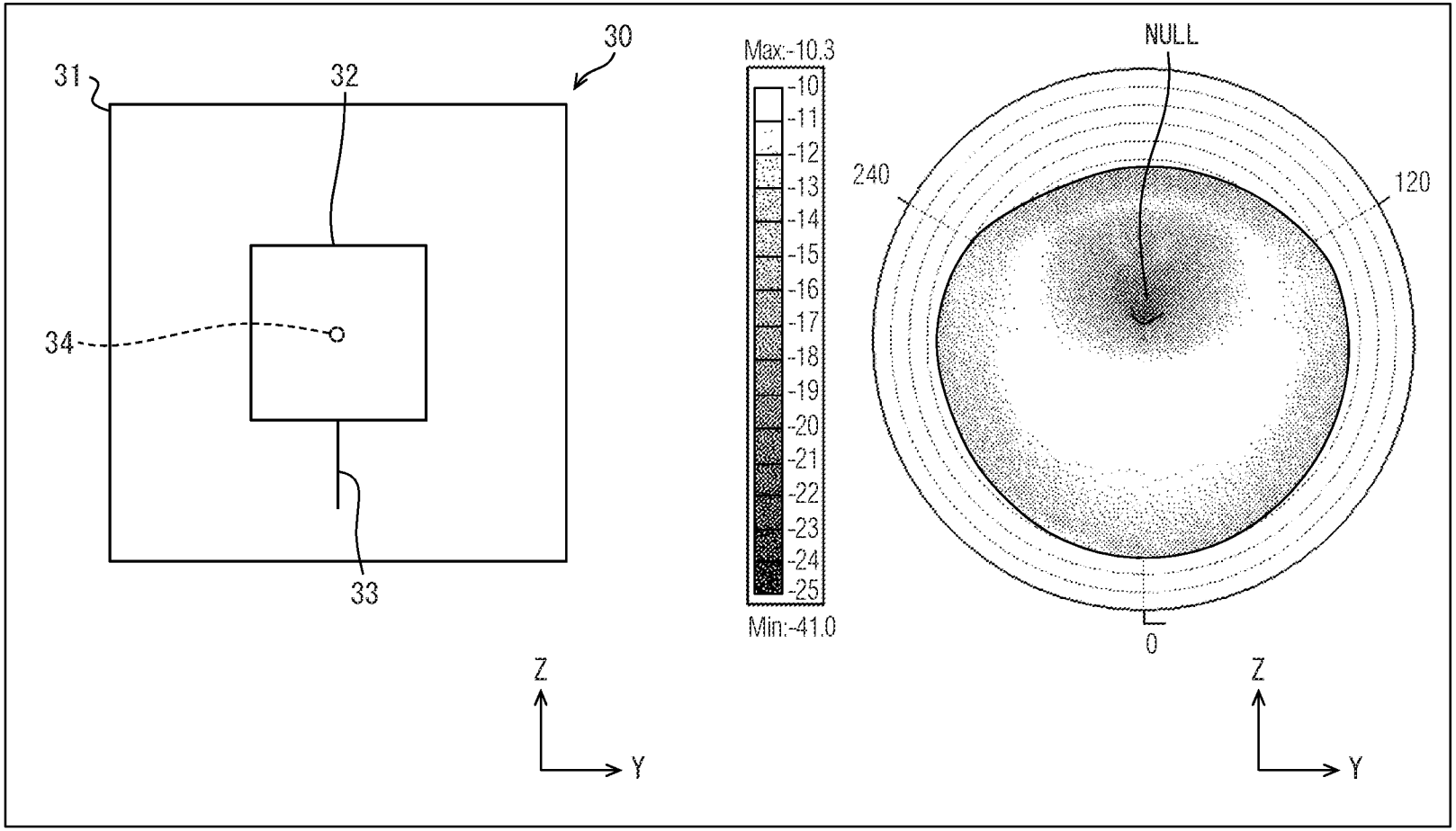
FIG. 6 is another diagram showing radiation characteristics of the zeroth-order resonance antenna.
Figure 7:
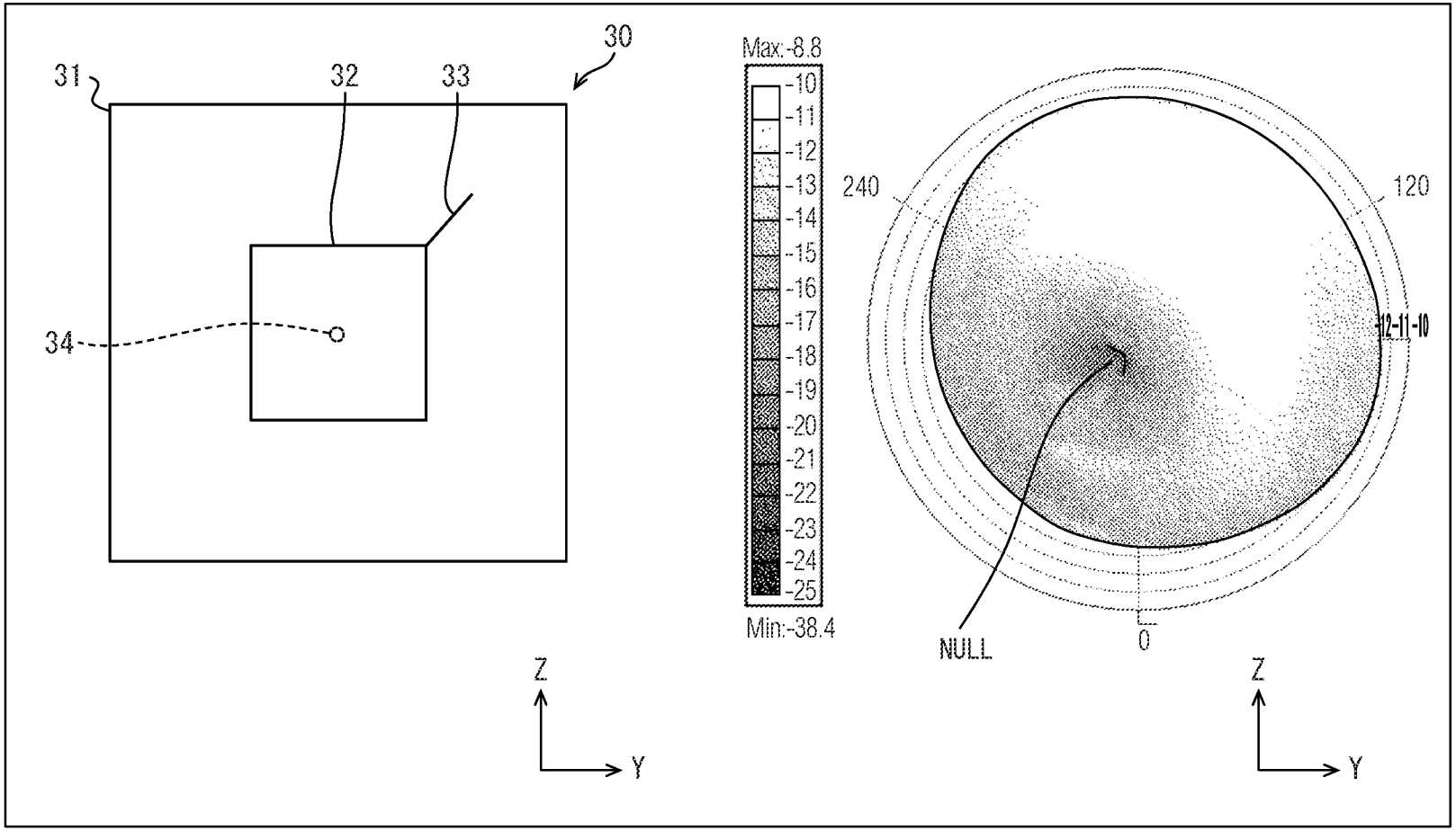
FIG. 7 is a diagram showing radiation characteristics of the zeroth-order resonance antenna.

Next, the extension direction and directivity of the feeder line 33, that is, the directivity of the zeroth-order resonance antenna 30 alone is described. FIG. 5, FIG. 6, and FIG. 7 show the extension direction of the feeder line 33 and the result (i.e., radiation characteristics) of the electromagnetic field simulation, respectively. In such simulation, the operating frequency, the configuration (i.e., dielectric constant and thickness) of the substrate 20 and the diameter of the short circuit portion 34 were made the same in the examples of FIGS. 5, 6, 7. That is, only the extension directions of the feeder lines 33 were made different from each other, and the simulation was performed under the same conditions for the other factors. For example, the operating frequency was set to 2.44 GHz. In FIGS. 5 to 7, for convenience, the substrate 20 is omitted from the illustration of the zeroth-order resonance antenna 30. In FIGS. 5 to 7, for the ease of seeing NULL, the higher the electric field intensity, the coarser the dots, and the lower the electric field intensity, the denser the dots.

FIG. 5 shows the radiation characteristics of the zeroth-order resonance antenna 30 configured in the same manner as in FIG. 1. The feeder line 33 extends in the Y direction from the edge of the patch portion 32. Due to the influence of the feeder line 33 arranged to face the main plate 31, the NULL is tilted toward the side opposite to the feeder line 33, and the directivity is biased to the side where the feeder line 33 is arranged.

In FIG. 6, the feeder line 33 extends in the Z direction. The feeder line 33 extends in the Z direction from one of the edges of the patch portion 32 that is substantially parallel to the Y direction. In the extension direction of the feeder line 33, the NULL is tilted toward the side opposite to the feeder line 33, and the directivity is biased to the side where the feeder line 33 is arranged.

In FIG. 7, the feeder line 33 extends diagonally. The feeder line 33 has a Y-direction component and a Z-direction component. The feeder line 33 has an acute angle with the virtual line substantially parallel to the Y direction and also an acute angle with the virtual line substantially parallel with the Z direction. The feeder line 33 extends from one of the four corners (i.e., one of quadrangle points) of the patch portion 32. In the extension direction of the feeder line 33, the NULL is tilted toward the side opposite to the feeder line 33, and the directivity is biased to the side where the feeder line 33 is arranged.

As described above, the zeroth-order resonance antenna 30 alone has directivity in the extension direction of the feeder line 33. The effects of the feeder line 33 on the directivity of the zeroth-order resonance antenna 30 is described in detail in Japanese Patent Application No. 2020-038072 by the applicant of present disclosure. The contents of such document are incorporated by reference as a description of the technical elements herein.

<Arrangement of Metal Body>

Figure 8:
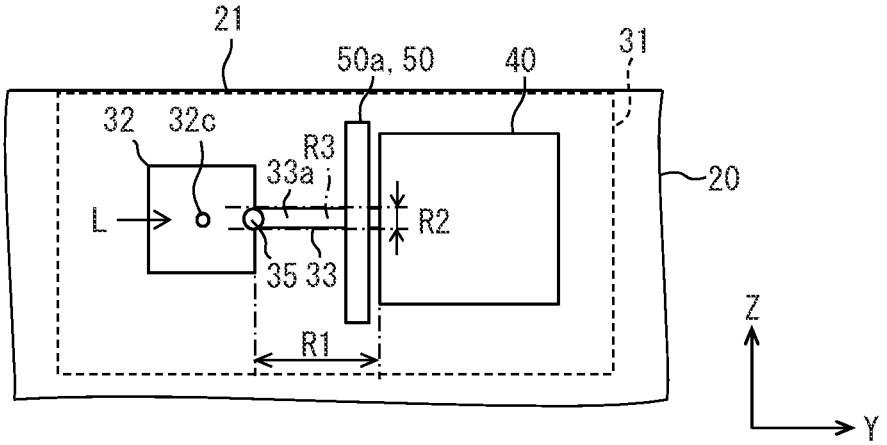
FIG. 8 is a diagram showing an example of arrangement of metal bodies.
Figure 9:
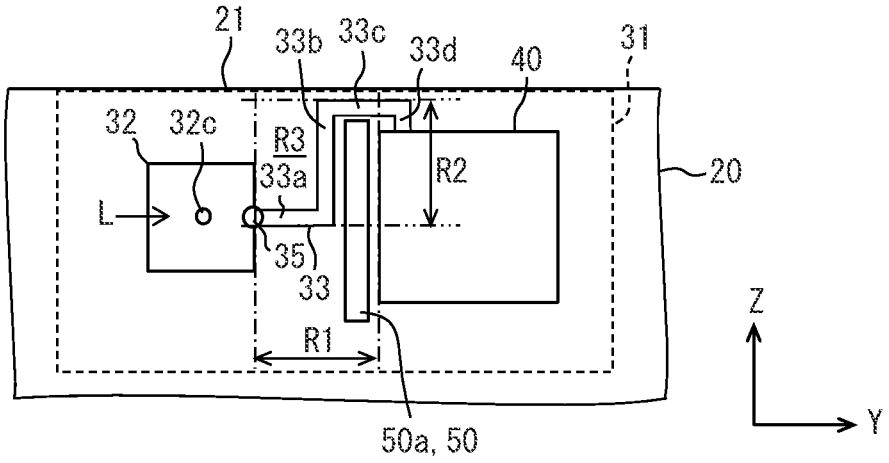
FIG. 9 is a diagram showing another example of arrangement of the metal bodies.

Next, the arrangement of the metal body 50 is described. FIG. 8 and FIG. 9 show the arrangement of the patch portion 32 of the zeroth-order resonance antenna 30, the feeder line 33, the high frequency circuit 40, and the metal body 50. A reference numeral 32*c* in the drawing indicates the center of the patch portion 32 in a plan view. A reference numeral 35 indicates a feeding point. FIG. 8 and FIG. 9 show at least a part of the metal body 50. In the present embodiment, a shield case is adopted as the metal body 50. FIG. 8 and FIG. 9 show only a part of the shield case which is the metal body 50.

In FIG. 8, the feeder line 33 extends in the Y direction as in FIG. 1. At least a part of the metal body 50 is arranged in an intersection region R3 of a region R1 and a region R2 in a plan view seen from the Z direction. The region R1 is a region between the patch portion 32 and the high frequency circuit 40 in a plan view. The region R1 is a region between the patch portion 32 and the high frequency circuit 40 in an alignment direction of the center 32*c* of the patch portion 32 and the feeding point 35. In FIG. 8, the region R1 is a region between (i) the feeding side of the patch portion 32 and (ii) the opposing side of the high frequency circuit 40 opposing to the patch portion 32.

The region R2 is a region within the width of the feeder line 33 when seen from an L direction, which is the alignment direction of the center 32*c* and the feeding point 35. The L direction substantially coincides with the Y direction in the present embodiment. In the example shown in FIG. 8, the feeder line 33 includes only the straight portion 33*a*. That is, the feeder line 33 has a straight line shape over the entire length from the feeding point 35 to the connection portion with the high frequency circuit 40. The feeder line 33 extends along the end portion 21 of the substrate 20. The width of the feeder line 33 is substantially equal in the entire length.

The intersection region R3 shown in FIG. 8 coincides with a forming region of the feeder line 33 in a plan view. A part of the metal body 50, specifically, one of side walls 50*a* of the shield case is arranged in the intersection region R3. The side wall 50*a* arranged in the intersection region R3 is located directly above the straight portion 33*a* of the feeder line 33. The side wall 50*a* is arranged on a protective film covering the feeder line 33 and extends in the X direction. In a plan view, the side wall 50*a* (i.e., the metal body 50) crosses the feeder line 33.

FIG. 9 shows an example of the feeder line 33 having a pattern different from that of FIG. 8. In FIG. 9, the feeder line 33 includes a first extension portion extending along the Y direction and a second extension portion extending along the Z direction. The straight portion 33*a* also serves as one of the first extension portions. One of the ends of a second extension portion 33*b* is connected to the end of the straight portion 33*a* opposite to the feeding point 35. The second extension portion 33*b* extends in the Z direction toward an end portion 21 of the substrate 20. The second extension portion 33*b* extends to a position closer to the end portion 21 than the patch portion 32 in the Z direction. One of the ends of a first extension portion 33*c* is connected to the other end of the second extension 33*b*. The first extension portion 33*c* extends in the Y direction and approaches the high frequency circuit 40. One of the ends of a second extension portion 33*d* is connected to the other end of the first extension portion 33*c*. The second extension portion 33*d* extends in the Z direction away from the end portion 21, that is, in the direction approaching the high frequency circuit 40. The width of the feeder line 33 is substantially equal in its entire length.

As described above, the region R1 is a region between the patch portion 32 and the high frequency circuit 40 in a plan view. Similar to FIG. 8, the region R1 is a region between the feeding side of the patch portion 32 and the opposing side of the high frequency circuit 40 opposing to the patch portion 32. The region R2 is a range of the width of the feeder line 33 as seen from the alignment direction of the center 32*c* and the feeding point 35, that is, the L direction. The width of the feeder line 33 seen in a plan view from the L direction is determined by the straight portion 33*a* and the first extension portion 33*c*, which corresponds to the first extension portions. As shown in FIG. 9, the side wall 50*a* of the shield case, which is the metal body 50, is arranged in the intersection region R3. The side wall 50*a* (i.e., the metal body 50) is arranged on a virtual extension line of the straight portion 33*a* of the feeder line 33.

Summary of First Embodiment

According to the wireless communication device 10 shown in the present embodiment, as described above, the directivity of the zeroth-order resonance antenna 30 alone is intentionally biased in the extension direction of the feeder line 33. That is, the electric field is concentrated in the extension direction of the feeder line 33. Then, by intentionally arranging at least a part of the metal body 50 in the direction in which the electric field is concentrated, specifically, in the above-mentioned intersection region R3, a part of the radio waves radiated in the extension direction is reflected for extending/widening the electric field. As described above, the antenna device including the zeroth-order resonance antenna 30 and the metal body 50 has directivity in a direction different from the extension direction of the feeder line 33. That is, it is possible to provide a wireless communication device having a desired directivity different from the extension direction (of the feeder line 30).

As an example, the feeder line 33 has a straight portion 33*a* extending in a straight line shape from the feeding point 35 on the same surface as the patch portion 32. The directivity of the zeroth-order resonance antenna 30 alone is greatly affected by the straight portion 33*a* of the feeder line 33, which is arranged on the same surface as the patch portion 32 and extends from the feeding point 35. That is, the electric field tends to concentrate in the direction along the straight portion 33*a*.

In the present embodiment, for example, in the example shown in FIG. 8, the metal body 50 is arranged directly above the straight portion 33*a*. The metal body 50 overlaps with the straight portion 33*a* in a plan view. The metal body 50 is arranged on the straight portion 33*a* via a solder resist (not shown). Therefore, the radio wave radiated in the extension direction of the feeder line 33 can be effectively reflected by the metal body 50 to extend the electric field. In the example shown in FIG. 9, the metal body 50 is arranged on an extension line of the straight portion 33*a*. Similar to FIG. 8, the radio wave radiated in the extension direction of the feeder line 33 can be effectively reflected by the metal body 50 to extend the electric field.

Figure 10:
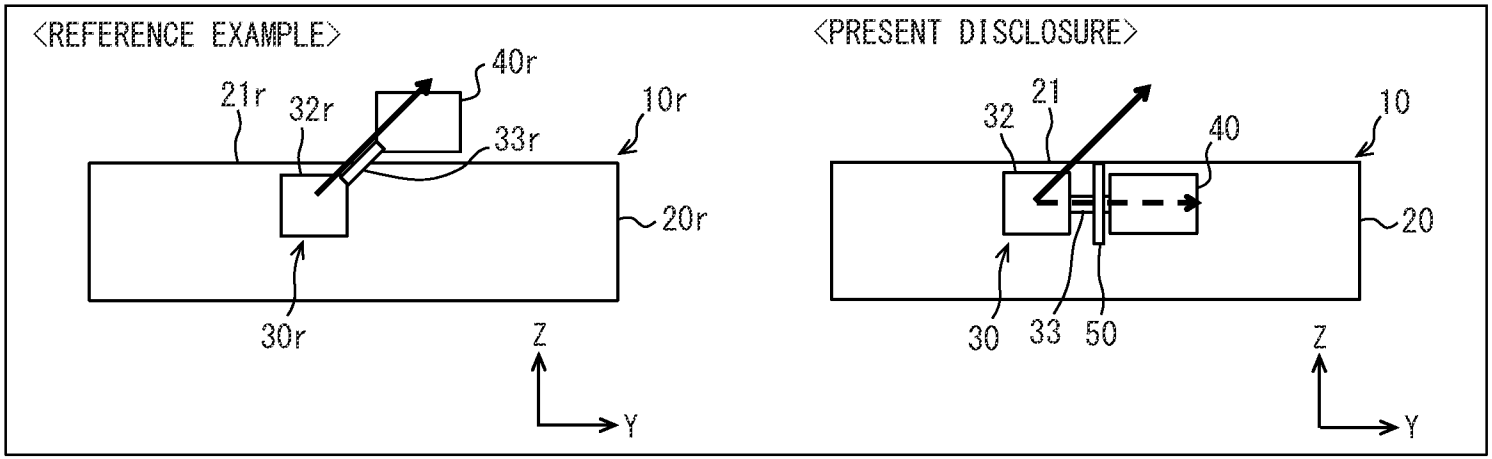
FIG. 10 is a diagram showing directivity of the example of the present disclosure and a reference example.

In FIG. 10, a reference example shows a wireless communication device 10*r* that secures a desired directivity only with a zeroth-order resonance antenna 30*r*. An example of the present disclosure shows an example of the wireless communication device 10 according to the present embodiment. In the reference example, a reference code r is added/appended to the number of the element that is the same as or related to the element of the present embodiment. As shown in FIG. 10, in both the reference example and the example of the present disclosure, the patch portions 32 and 32*r*, and thus the zeroth-order resonance antennas 30 and 30*r*, are arranged in the vicinity of the end portions 21 and 21*r* of the substrates 20 and 20*r*.

In the reference example, when trying to obtain the directivity in the direction of a solid line arrow including the Z-direction component with the zeroth-order resonance antenna 30*r* alone, the feeder line 33*r* needs to extend to the outside of the end portion 21*r* of the substrate 20*r* and the high frequency circuit 40 must be arranged outside the substrate 20. That is, the desired directivity cannot be obtained by the zeroth-order resonance antenna 30*r* mounted on the substrate 20*r* alone.

On the other hand, in the example of the present disclosure, the feeder line 33 is extended in the Y direction. As a result, the zeroth-order resonance antenna 30 alone has directivity in the direction indicated by a broken line arrow, that is, in the Y direction. Further, due to the arrangement of the metal body 50, a part of the radio waves radiated in the Y direction is reflected and the electric field is extended. As such, by combining the zeroth-order resonance antenna 30 and the metal body 50, it is possible to have a desired directivity including a Z-direction component as shown by the solid line arrow. That is, even in a configuration in which the patch portion 32 is arranged in the vicinity of the end portion 21 of the substrate 20, the directivity can be oriented in such a direction extending from the patch portion 32 toward the end portion 21, that is, in the direction toward the outside of the substrate 20.

As an example, the metal body 50 is mounted on the one surface 20*a* of the substrate 20. That is, the metal body 50 is surface-mounted. According to such configuration, the metal body 50 can be highly-precisely arranged at desired position. Therefore, the desired directivity is highly-precisely realized.

As an example, at least a part of the patch portion 32 and the feeding line 33 is arranged on the one surface 20*a* of the substrate 20. The surface-mounted metal body 50 projects upward than the patch portion 32 from the one surface 20*a*. In the X direction (vertical direction), the height of the metal body 50 is greater than the thickness of the patch portion 32. As a result, the radio waves radiated from the zeroth-order resonance antenna 30 can be effectively reflected by the metal body 50.

As an example, a shield case that protects the high frequency circuit 40 is adopted as the metal body 50. According to such a configuration, as the metal body 50, it is not necessary to separately prepare a metal block or the like, thereby the structure can be simplified.

Figure 11:
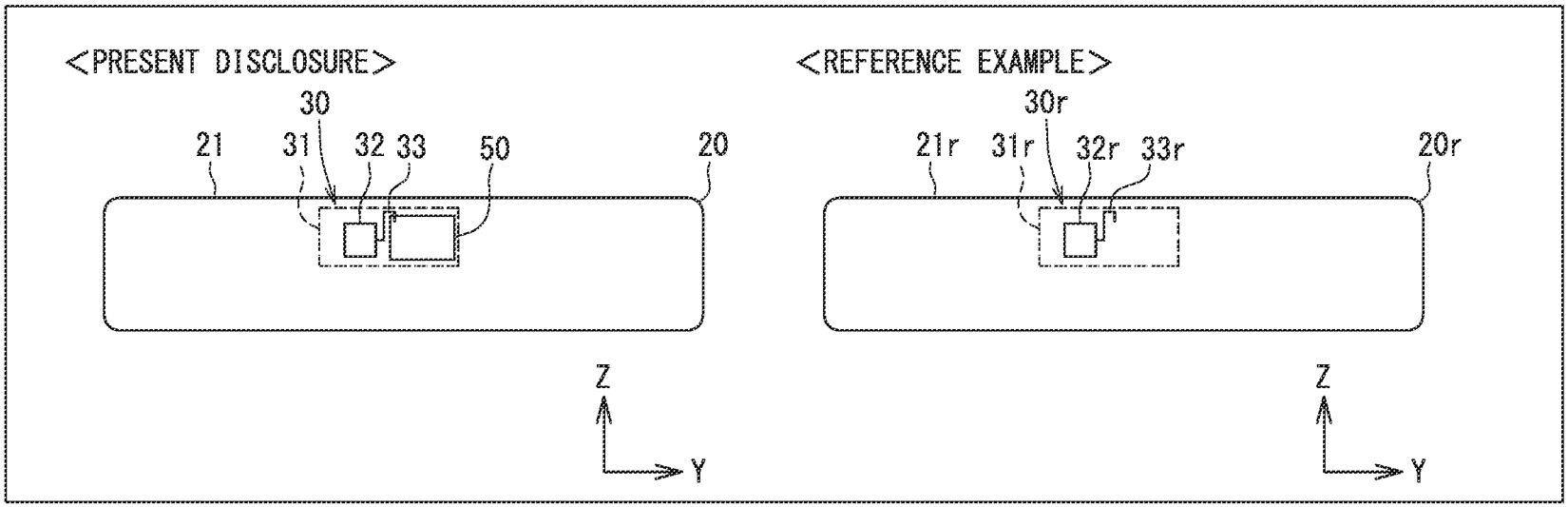
FIG. 11 is a diagram showing a configuration of the example of the present disclosure and a reference example used in an electromagnetic field simulation.

The results of evaluating the example of the present disclosure and the reference example by electromagnetic field simulation are shown below. FIG. 11 shows a schematic configuration of the example of the present disclosure and a reference example used in the simulation. Similar to FIG. 10, in the reference example, the reference code of r is added/appended to the number of the element that is the same as or related to the element of the present embodiment. The example of the present disclosure includes a metal body 50. On the other hand, the reference example does not include a metal body. In the example of the present disclosure and the reference example, the conditions were the same except for the presence or absence of a metal body. The operating frequency is set to 2.44 GHz. The zeroth-order resonance antennas 30 and 30*r* were arranged in the vicinity of the end portions 21 and 21*r* of the substrates 20 and 20*r*. The patterns of the feeder lines 33 and 33*r* were the same as those shown in FIG. 9. Both the metal bodies 50 and 50*r* are assumed to be shield cases.

Figure 12:
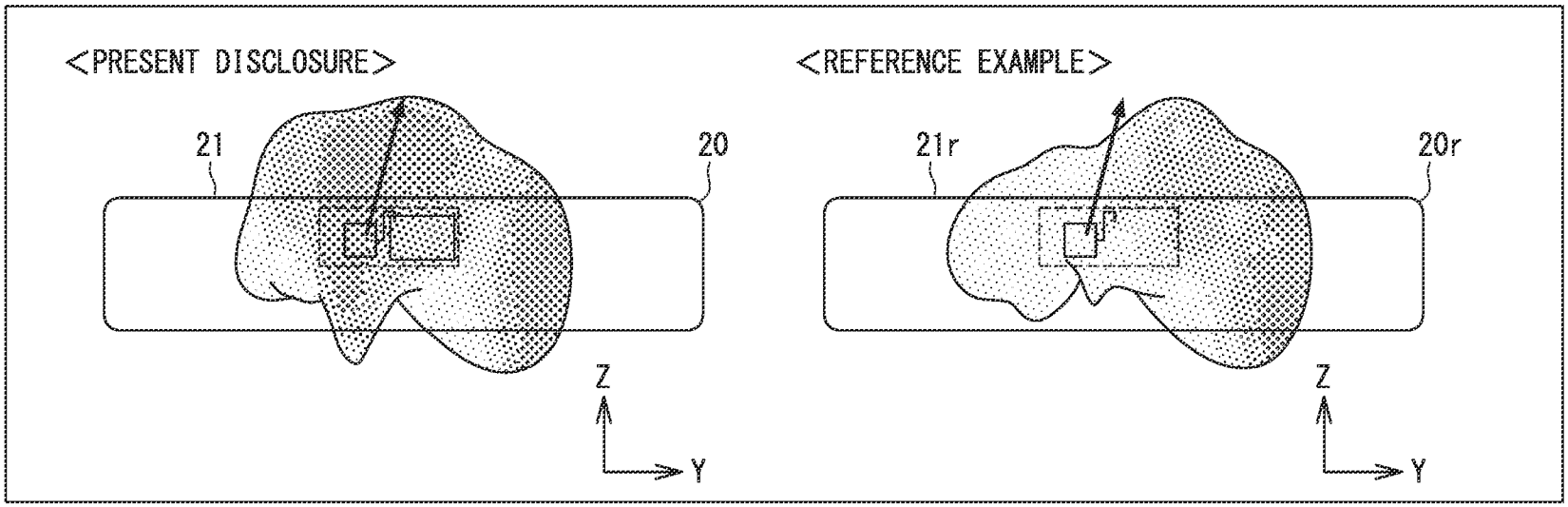
FIG. 12 is a diagram showing radiation characteristics of the example of the present disclosure and a reference example.
Figure 13:
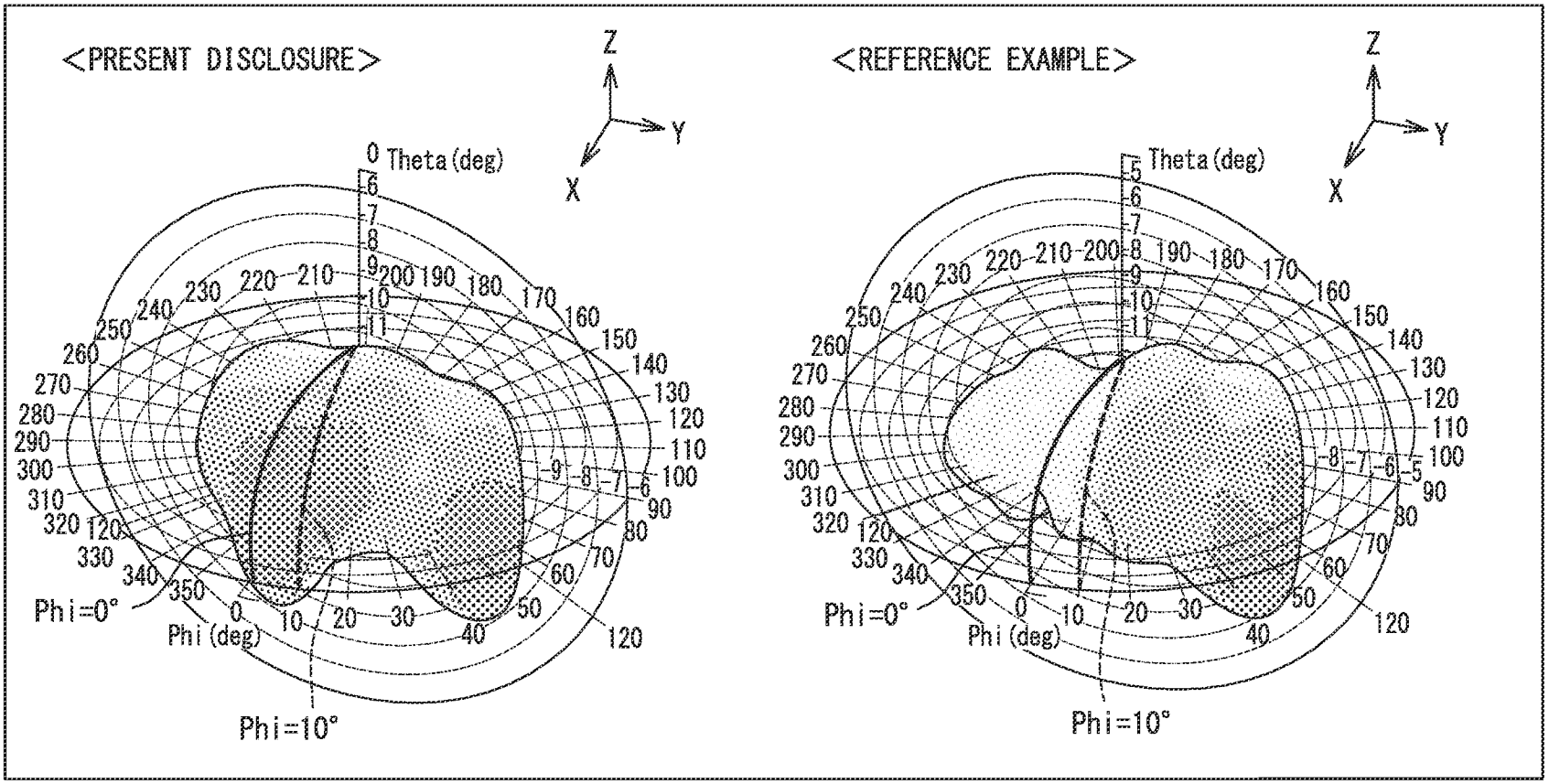
FIG. 13 is a diagram showing radiation characteristics of the example of the present disclosure and a reference example.

FIG. 12 and FIG. 13 show the results (i.e., radiation characteristics) of the electromagnetic field simulation. In FIGS. 12 and 13, unlike FIGS. 5 to 7, the higher the electric field intensity, the denser the dots, and the lower the electric field intensity, the coarser the dots. FIG. 12 shows an electric field intensity distribution on the ZY plane for the ease of understanding of the directivity. FIG. 13 shows an electric field intensity distribution in a state where the substrate is erected so that changes other than the Y direction can be easily understood. The aiming direction of the directivity is the direction indicated by a solid line arrow in FIG. 12. The aiming direction is the direction outside the edge of the substrate from the patch portion and slightly inclined from the Z direction. The aiming direction is the direction along which the feeder line cannot be drawn out, that is, a direction in which the high frequency circuit cannot be arranged.

As shown in FIGS. 12 and 13, in the reference example, the electric field is concentrated in the Y direction. On the other hand, in the example of the present disclosure, it can be seen that the electric field extends in other directions as well. In the example of the present disclosure, the electric field also extends in the X and Z directions. Then, as shown in FIG. 12, it has directivity in the target direction.

Figure 14:
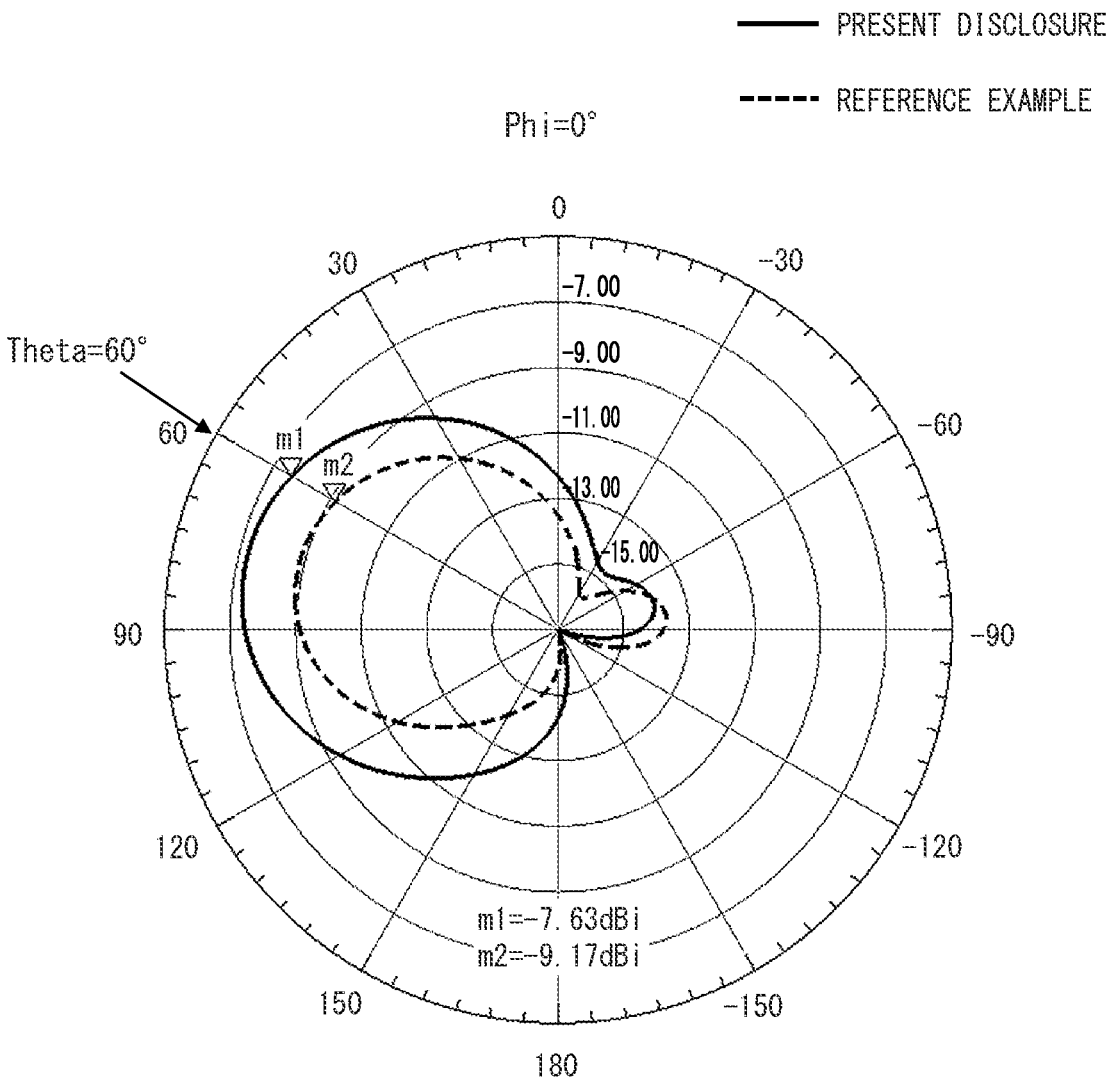
FIG. 14 is a diagram comparing radiation characteristics on a plane of Ph=0°.
Figure 15:
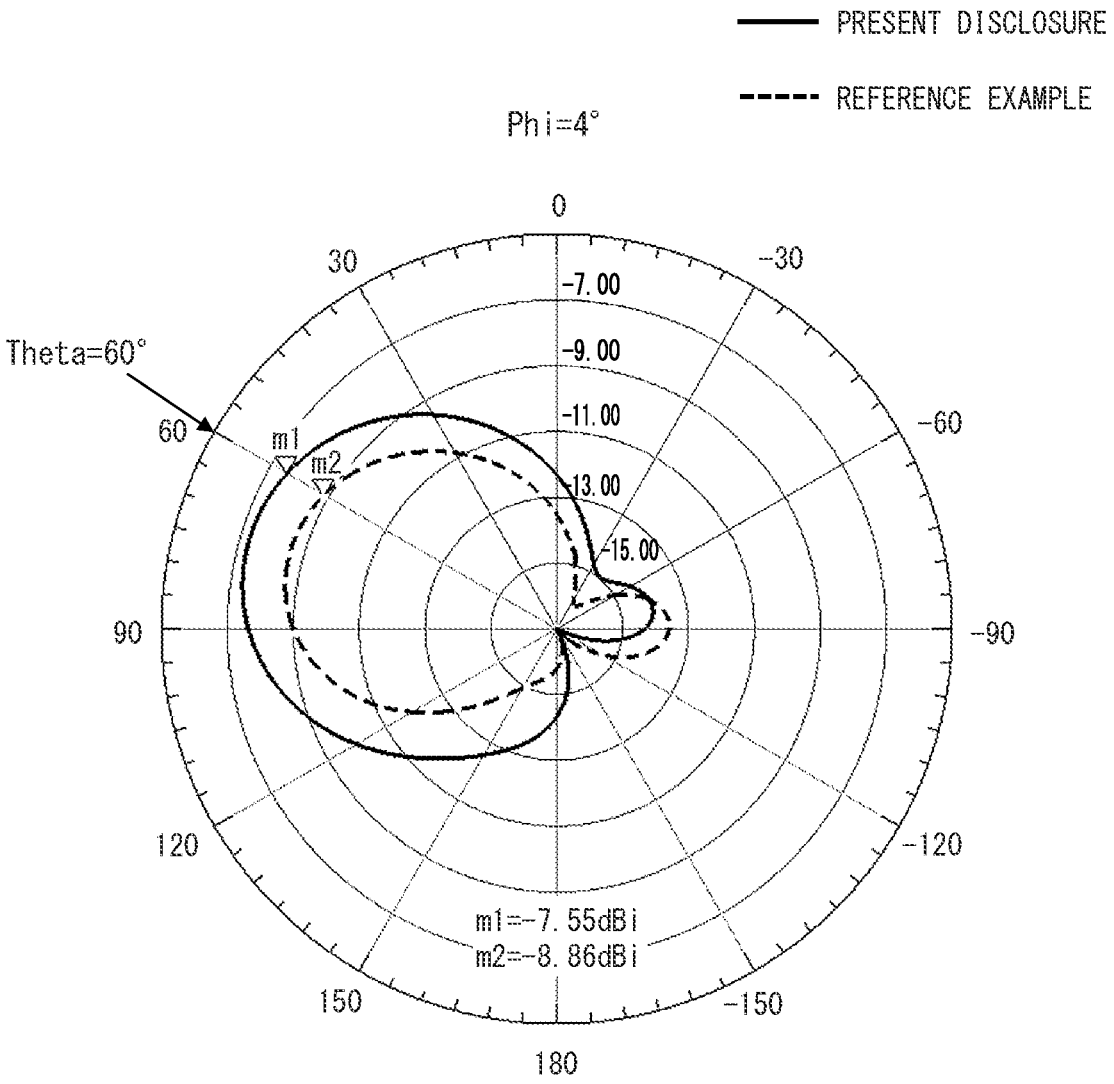
FIG. 15 is a diagram comparing the radiation characteristics on a plane of Ph=4°.
Figure 16:
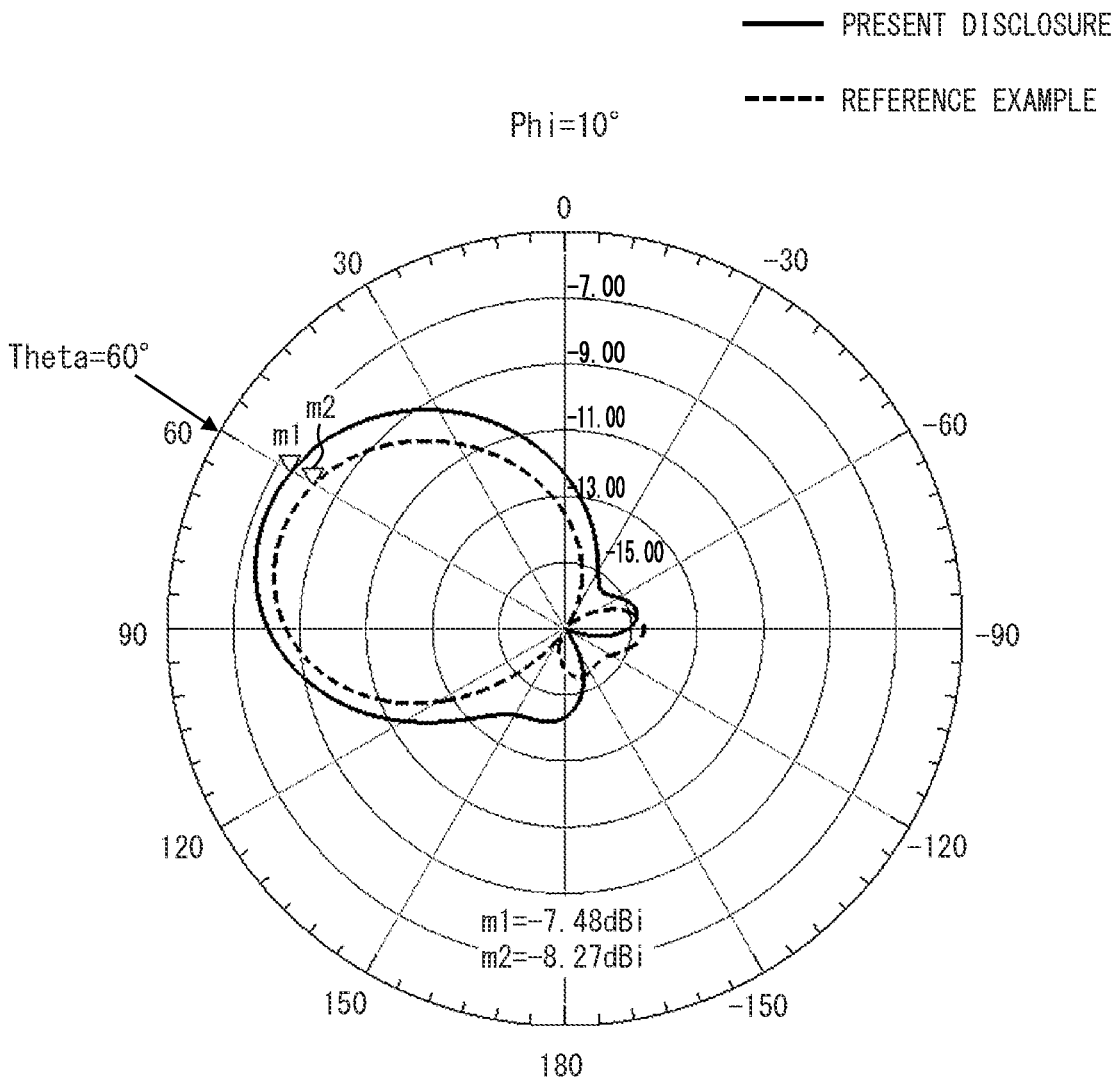
FIG. 16 is a diagram comparing radiation characteristics on a plane of Ph=10°.

FIG. 14 is a diagram comparing the radiation characteristics of the example of the present disclosure and the reference example on a plane of Phi=0° shown by the solid line in FIG. 13. The plane with Ph=0° is the ZX plane. FIG. 15 is a diagram comparing the radiation characteristics of the example of the present disclosure and the reference example on a plane of Phi=4°. FIG. 16 is a diagram comparing the radiation characteristics of the example of the present disclosure and the reference example on a plane of Phi=10° shown by the broken line in FIG. 13. In each of the drawings, the solid line shows the example of the present disclosure and the broken line shows a reference example. m1 is the gain (gain) of the example of the present disclosure, and m2 is the gain of the reference example. m1 and m2 are values of Theta=60° on each surface. m1 and m2 are substantially equal to their respective maximum gains.

As shown in FIG. 14, on the plane of Phi=0°, m1=−7.63 [dBi] and m2=−9.17 [dBi]. As shown in FIG. 15, on the plane of Ph=4°, m1=−7.55 [dBi] and m2=−8.86 [dBi]. As shown in FIG. 16, on the plane of Ph=10°, m1=−7.48 [dBi] and m2=−8.27 [dBi]. The closer the value of Phi is to 0°, the greater the difference between the gain m1 of the example of the present disclosure and the gain m2 of the reference example. That is, it shows that the electric field extends in a direction different from the Y direction, specifically, in the X direction.

As described above, from the simulation results, it is clear that the radio waves radiated from the patch portion 32 of the zeroth-order resonance antenna 30 in the Y direction are reflected by the metal body 50, thereby the electric field extends in the X direction and the Z direction. That is, it is clarified that the directivity can be provided in the target direction in which the feeder line 33 cannot be pulled out, which is different from the extension direction of the feeder line 33.

Modified Example

As the metal body 50, an example of a shield case of the high frequency circuit 40 is shown. However, the present disclosure is not limited to such an example. As described above, the metal portion included in the metal block or the connector may be provided as the metal body 50. The metal block may be, for example, a columnar metal body.

Figure 17:
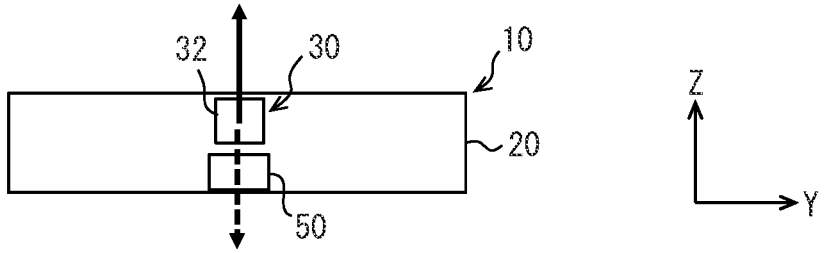
FIG. 17 is a diagram showing a modified example.

The aiming direction of directivity is not limited to the above-described example. For example, as shown in FIG. 17, by the reflection of the metal body 50, the directivity of the zeroth-order resonance antenna 30 may be oriented to be opposite to that of the zeroth-order resonance antenna 30 by itself. In FIG. 17, the directivity direction of the zeroth-order resonance antenna 30 by itself is shown by a broken line, and the directivity of the antenna device including the zeroth-order resonance antenna 30 and the metal body 50 is shown by a solid line. The same applies to the following modified examples.

Figure 18:
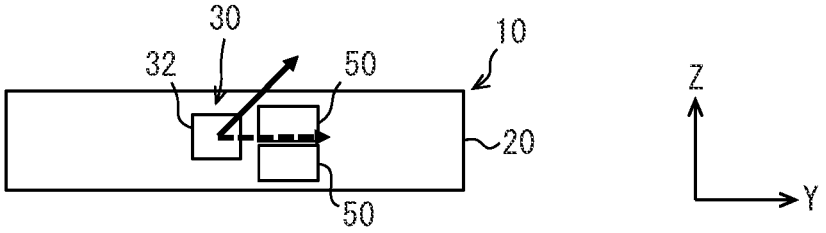
FIG. 18 is a diagram showing another modified example.

An example is shown in which the wireless communication device 10 includes one metal body 50. However, the present disclosure is not limited to such. A plurality of metal bodies 50 may be provided. In an example shown in FIG. 18, the wireless communication device 10 includes two metal bodies 50. Each of the metal bodies 50 is mounted on the same substrate 20. It may also be configured to include three or more metal bodies 50.

Figure 19:
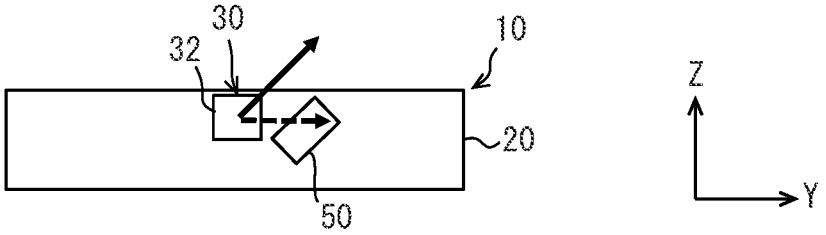
FIG. 19 is a diagram showing yet another modified example.

The orientation of the metal body 50 on the substrate 20 is not particularly limited. For example, as shown in FIG. 19, the four sides of the metal body 50 having a substantially rectangular shape in a plane may be inclined with respect to the directivity of the zeroth-order resonance antenna 30 by itself. That is, the metal body 50 may be arranged as tilted from the extension direction of the feeder line 33. Each side of the metal body 50 may be arranged not to be substantially parallel in the Y direction nor the Z direction.

Figure 20:
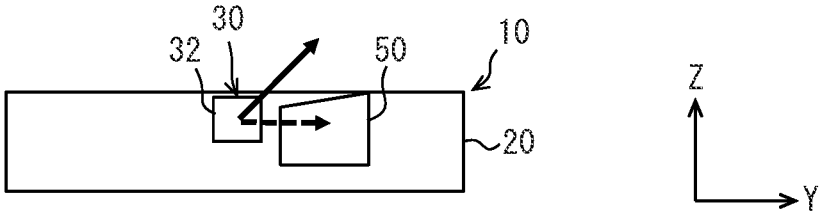
FIG. 20 is a diagram showing yet another modified example.

The plane shape of the metal body 50 is not particularly limited. For example, as shown in FIG. 20, a flat trapezoidal metal body 50 may be adopted. In addition to the above, a square, a parallelogram, a polygonal shape other than a rectangular shape, a circular shape, or the like can also be adopted.

Second Embodiment, FIGS. 21-24

The second embodiment is a modification of a preceding embodiment as a basic configuration and may incorporate description of the preceding embodiment.

Figure 21:
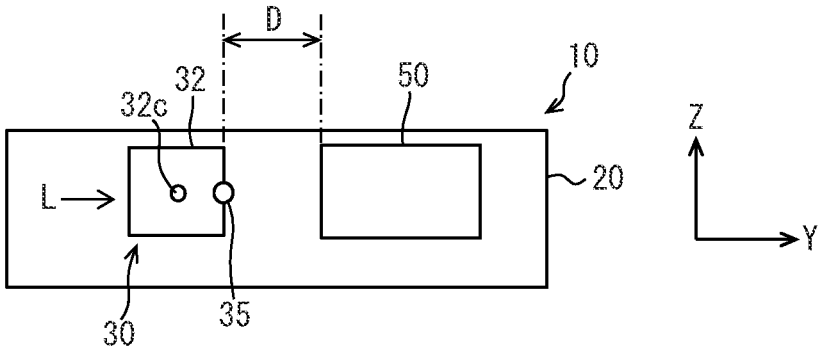
FIG. 21 is a diagram showing a distance between a patch portion and a metal body in the wireless communication device according to a second embodiment.

FIG. 21 is a diagram showing a distance between the patch portion 32 and the metal body 50 in the wireless communication device 10 according to the present embodiment. Elements other than the substrate 20, the patch portion 32, and the metal body 50 are omitted for convenience. The feeder line 33 extends in the Y direction. A distance D between the patch portion 32 and the metal body 50 is a facing distance in a plan view. In other words, it is a distance between the patch portion 32 and the metal body 50 in the L direction, which is an alignment direction between the center 32*c* of the patch portion 32 and the feeding point 35. The distance D satisfies a relationship of $0<D<\lambda\times 1/2$, where λ is the wavelength of the radio wave of the operating frequency of the zeroth-order resonance antenna 30. The zeroth-order resonance antenna 30 is mounted on the substrate 20, and the wavelength λ is the wavelength λε described above. Other configurations are the same as those described in the preceding embodiments. The pattern of the feeder line 33 is the same as that of FIGS. 9 and 11 of the preceding embodiment.

Summary of Second Embodiment

Figure 22:
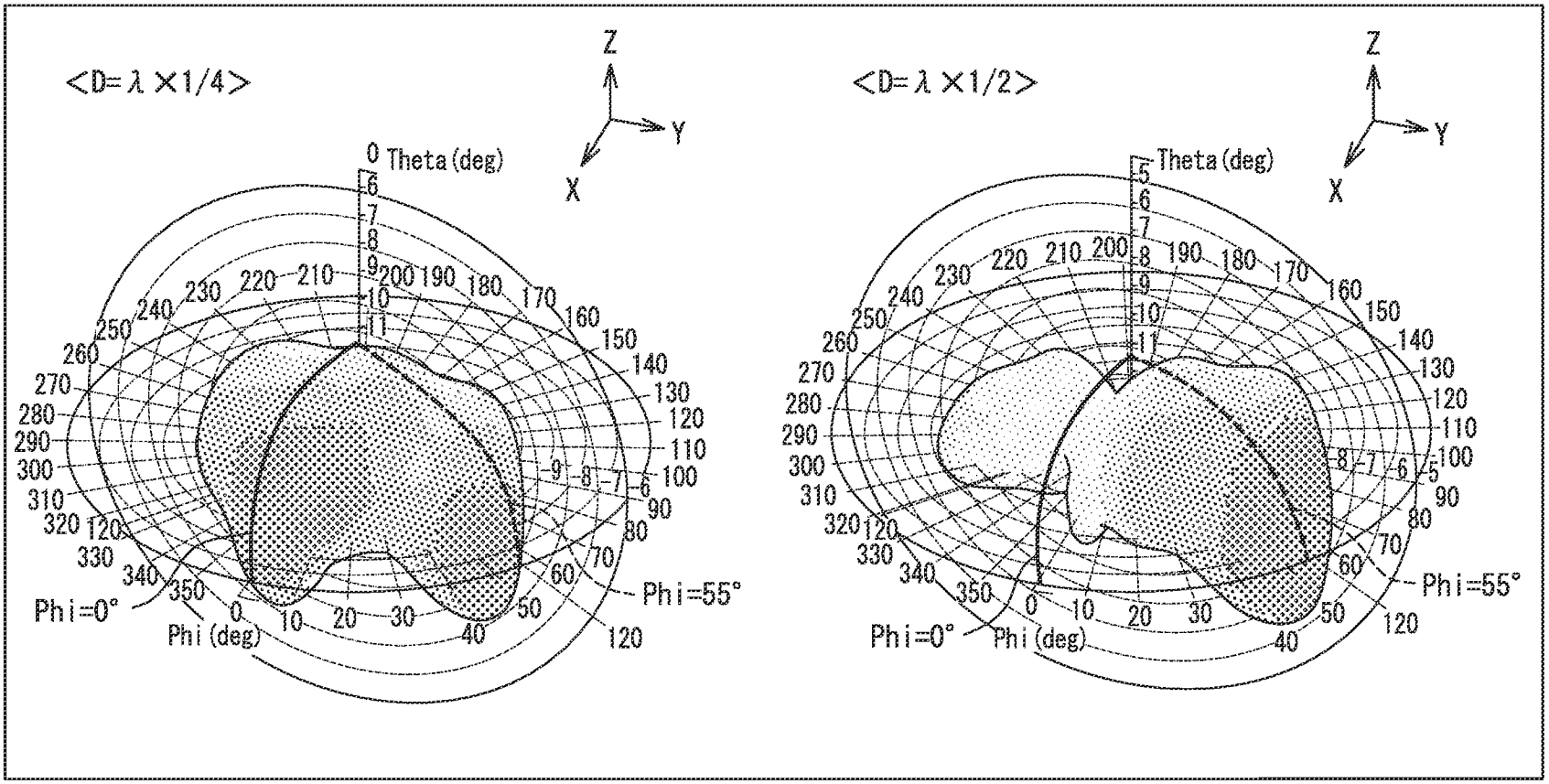
FIG. 22 is a diagram showing radiation characteristics when a distance is equal to half wavelength and ¼ wavelength.
Figure 23:
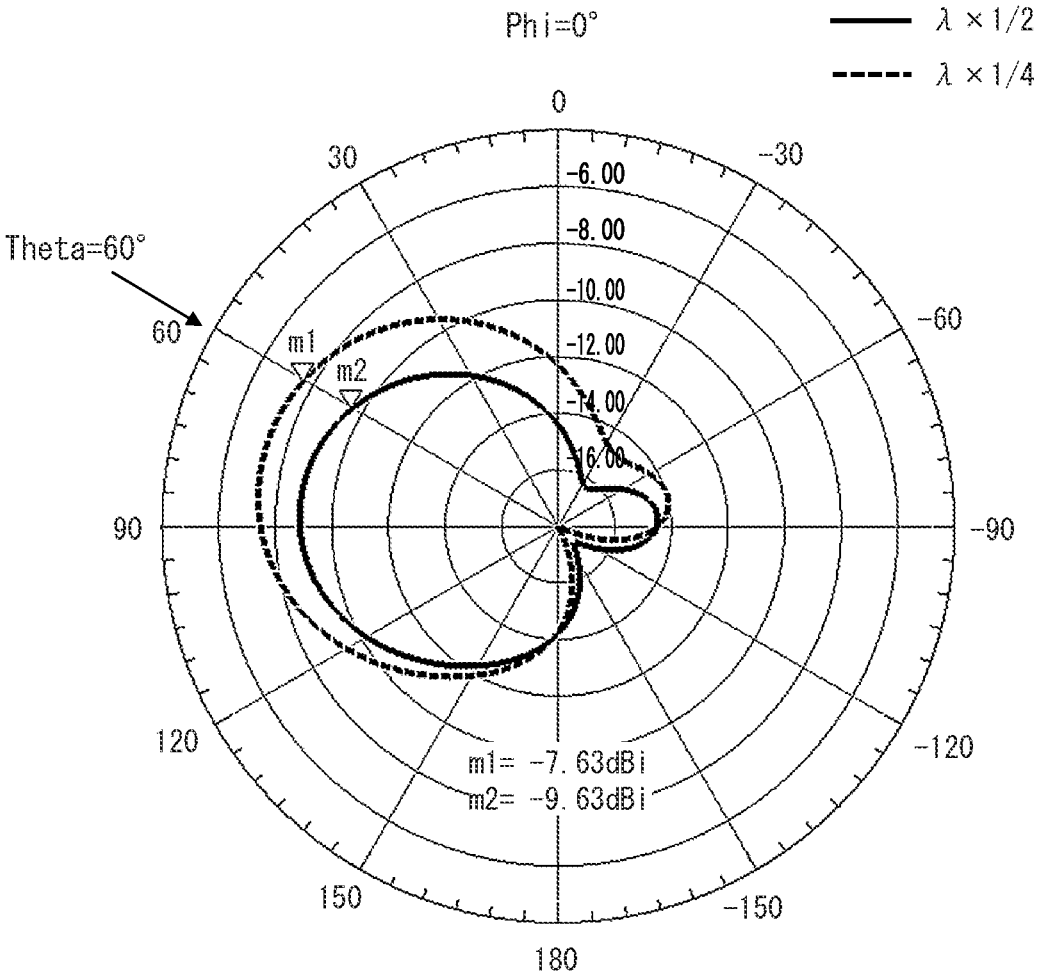
FIG. 23 is a diagram comparing radiation characteristics on a plane of Ph=0°.
Figure 24:
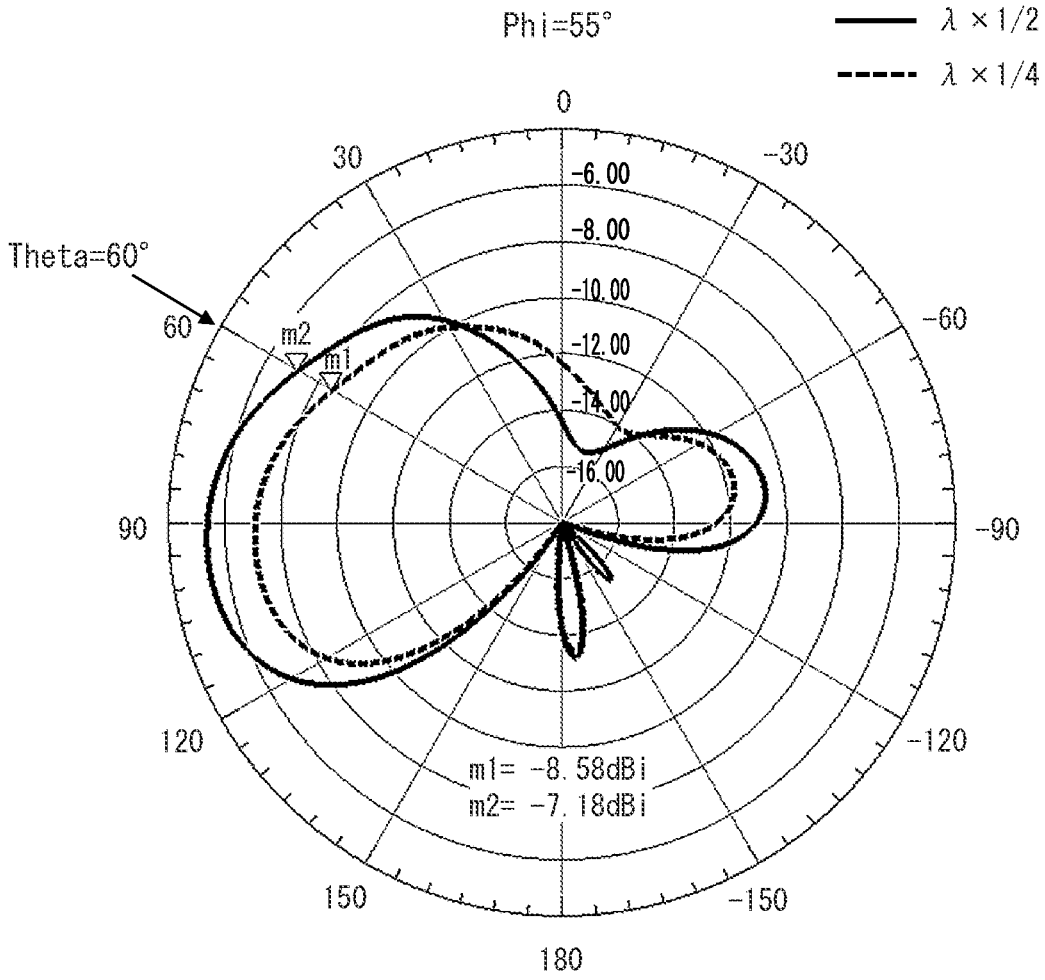
FIG. 24 is a diagram comparing radiation characteristics on a plane of Ph=55°.

FIGS. 22, 23, and 24 show the results of the electromagnetic field simulation. In the simulation, a case where the distance D is λ×½, that is, equal to one half wavelength is compared with a case where λ×¼, that is, is equal to one-quarter wavelength. In the following, when the distance is equal to ½ wavelength, it may simply be referred to as a ½ wavelength. Similarly, when the distance is equal to ¼ wavelength, it may simply be referred to as a ¼ wavelength. Other conditions are set to be the same as the preceding embodiment of the present disclosure. That is, the pattern of the feeder line 33 is the same as in FIGS. 9 and 11. The operating frequency is set to 2.44 GHz.

FIG. 22 shows respective radiation characteristics. In FIG. 22, just like FIGS. 12 and 13, the higher the electric field intensity, the denser the dots, and the lower the electric field intensity, the coarser the dots. FIG. 22 shows the electric field intensity distribution in the state where the substrate is upright, as in FIG. 13. FIG. 23 is a diagram comparing the radiation characteristics of the ½ wavelength and the ¼ wavelength on the plane of Phi=0° shown by the solid line in FIG. 22. FIG. 24 is a diagram comparing the radiation characteristics of ½ wavelength and ¼ wavelength on the plane of Phi=55° shown by the broken line in FIG. 22. In FIGS. 23 and 24, the solid line indicates ½ wavelength and the broken line indicates ¼ wavelength. m1 is a gain of ¼ wavelength, and m2 is a gain of ½ wavelength. m1 and m2 are values of Theta=60° on each surface. m1 and m2 are substantially equal to their respective maximum gains.

As shown in FIG. 22, it can be seen that the concentration of the electric field in the Y direction is suppressed and the electric field extends in the other direction at the ¼ wavelength than at the ½ wavelength. At ¼ wavelength, the electric field also extends in the X and Z directions. That is, it can be seen that the feeder line 33 has directivity in a direction different from the extension direction.

As shown in FIG. 23, on the plane of Phi=0°, m1=−7.63 [dBi] and m2=−9.63 [dBi]. As shown in FIG. 24, in the plane of Phi=55°, m1=−8.58 [dBi] and m2=−7.18 [dBi]. In the plane of Phi=0°, the gain of ¼ wavelength is greater than the gain of ½ wavelength. On the plane of Phi=55°, which is closer to the Y direction than Phi=0°, the gain of ¼ wavelength is smaller than the gain of ½ wavelength. The gain of ¼ wavelength is greater at the value of Phi=0° than at the value of Phi=55°. The gain of ½ wavelength is larger at the value of Phi=55° than at the value of Phi=0°. That is, it was clarified that the ¼ wavelength has a higher effect of extending the electric field in the Z direction and the X direction due to the reflection of the metal body 50.

As described above, the simulation result shows that when the distance D is set within the range of 0<D<λ×½, the metal body 50 can effectively reflect the radio waves radiated from the patch portion 32 in the Y direction. That is, it shows that the electric field extends in the X direction and the Z direction. By setting the distance D within the above-described range in addition to providing the metal body 50, it becomes easy to give directivity in a direction different from the extension direction of the feeder line 33. In particular, it is more effective if the distance D is set to a distance substantially equal to ¼ wavelength.

Figure 25:
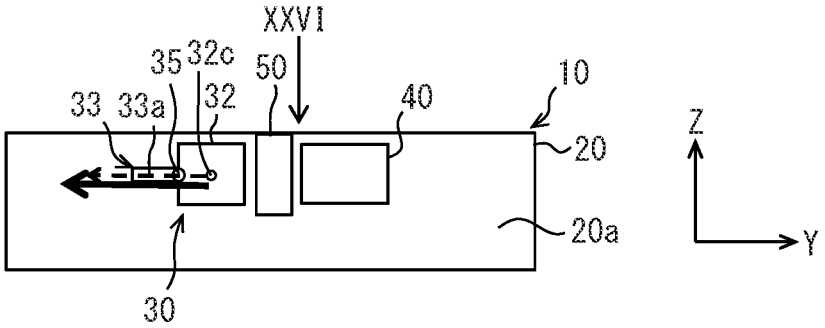
FIG. 25 is a plan view showing the wireless communication device according to a third embodiment.

Third Embodiment, FIG. 25

The second embodiment is a modification of a preceding embodiment as a basic configuration and may incorporate description of the preceding embodiment. In the preceding embodiments, a feeding point is provided on one side of the patch portion facing the high frequency circuit. Instead, a feeding point may be provided on the non-facing side of the high frequency circuit.

Figure 26:
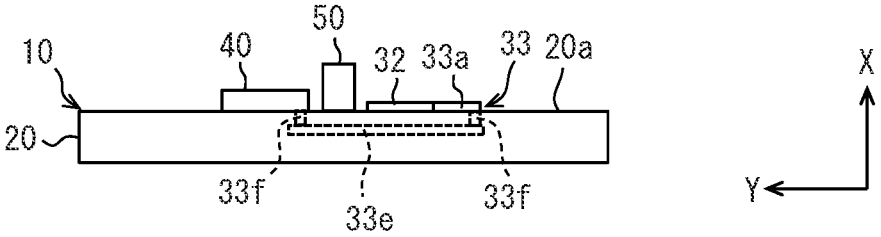
FIG. 26 is a side view of FIG. 25 as seen from a XXVI direction.

FIG. 25 is a plan view showing a schematic configuration of the wireless communication device 10 according to the present embodiment. FIG. 26 is a side view of FIG. 25 as seen from a XXVI direction. The feeding point 35 is provided in the patch portion 32 on a side opposite to the side facing the high frequency circuit 40. The feeder line 33 has a straight portion 33*a* arranged on the same surface as the patch portion 32. The straight portion 33*a* extends from the feeding point 35 in the Y direction and in the direction away from the high frequency circuit 40. The patch portion 32 and the straight portion 33*a* are arranged on the one surface 20*a* of the substrate 20.

The feeder line 33 has an inner layer conductor 33*e* and a via conductor 33*f* in addition to the straight portion 33*a*. The inner layer conductor 33*e* is a conductor pattern arranged inside the substrate 20 (e.g., under the surface) which has insulating base materials laminated in multiple layers. That is, the inner layer conductor 33*e* is an inner layer pattern. The via conductor 33*f* is formed by arranging a conductor such as plating in a through hole penetrating at least one layer of the insulating base material. Through holes may sometimes be referred to as vias. The patch portion 32 is electrically connected to the high frequency circuit 40 via (i.e., by way of) the straight portion 33*a* of the feeder line 33, the via conductor 33*f*, the inner layer conductor 33*e*, and the via conductor 33*f*. The inner layer conductor 33*e* and the via conductor 33*f* are arranged so as not to come into contact with the other elements of the zeroth-order resonance antenna 30.

The patch portion 32 and the high frequency circuit 40 are arranged side by side in the Y direction as in FIG. 1 shown in the preceding embodiment. The high frequency circuit 40 is mounted on the one surface 20*a* of the substrate 20. The metal body 50 is arranged in a region between the patch portion 32 and the high frequency circuit 40 in a plan view. The metal body 50 is arranged in a region between (i) the non-feeding side which is the opposing/non-facing side of the patch portion 32 to the high frequency circuit 40 and (ii) an opposing side of the high frequency circuit 40 opposing to the patch portion 32. In the patch portion 32, the side facing the high frequency circuit 40 is a side opposite to the feeding side. The metal body 50 is arranged on a virtual extension line of the straight portion 33*a* of the feeder line 33. The metal body 50 is arranged within the width of the straight portion 33*a* seen from the alignment direction of the center 32*c* and the feeding point 35. Other configurations are the same as those described in the preceding embodiments.

Summary of Third Embodiment

As described above, in the present embodiment, the feeding point 35 is provided in the patch portion 32 on the side opposite to the side facing the high frequency circuit 40. The straight portion 33*a* of the feeder line 33, which has a large influence on the directivity, extends from the feeding point 35 in the Y direction away from the high frequency circuit 40. As a result, the zeroth-order resonance antenna 30 has, by itself, as shown by a broken line arrow in FIG. 25, directivity in such a direction as aligned with the broken line arrow. Although the zeroth-order resonance antenna 30 has directivity in the extension direction of the straight portion 33*a*, as is clear from FIGS. 5 to 7, 12 and the like, a considerable amount of radio waves are transmitted/radiated in the direction opposite to the extension direction.

In the present embodiment, the metal body 50 is arranged between the patch portion 32 and the high frequency circuit 40. The metal body 50 is arranged on the side opposite to the straight portion 33*a* with respect to the patch portion 32. The metal body 50 reflects a part of the radio waves radiated from the patch portion 32 to/toward the high frequency circuit 40 side. As a result, the electric field is further concentrated in the extension direction of the straight portion 33*a* with respect to the patch portion 32. That is, the antenna device including the zeroth-order resonance antenna 30 and the metal body 50 has a desired directivity, and can have stronger/more intense directivity than the zeroth-order resonance antenna 30 alone. In FIG. 25, the directivity of the antenna device is indicated by a solid line arrow.

Other Embodiments

The present disclosure in the specification and drawings is not limited to the exemplified embodiments described therein. The present disclosure includes exemplary embodiments and modifications thereof by those skilled in the art based on the exemplary embodiment. For example, the present disclosure is not limited to the combination of the components and/or elements shown in the embodiments. The present disclosure can be carried out in various combinations. The present disclosure can have additional portions that can be added to the embodiment. The present disclosure includes the modified embodiment from which the components and/or elements of the embodiment are omitted. The present disclosure includes the reallocation or combination of the components and/or elements between one embodiment and the other. The technical scope disclosed is not limited to the description of the embodiments. Some technical scopes disclosed are indicated by the claims description and should be understood to include all modifications within the meaning and scope equivalent to the claims statement.

The present disclosure in the specification, drawings and the like is not limited by the description of the claims. The present disclosure in the specification, the drawings, and the like encompass the technical ideas described in the claims, and further extend to a wider variety of technical ideas than those in the claims. Therefore, various technical ideas can be extracted from the present disclosure of the specification, the drawings and the like without being limited to the description of the claims.

When an element or a layer is described as "disposed above" or "connected," the element or the layer may be directly disposed above or connected to another element or another layer, or may also have an intervening element or an intervening layer disposed therebetween. In contrast, when an element or a layer is described as "disposed directly above" or "directly connected," an intervening element or an intervening layer is not present. Other terms used to describe the relationships between elements (for example, "between" vs. "directly between", and "adjacent" vs. "directly adjacent") should be interpreted similarly. The term "and/or" used herein includes any combination, and all combinations, with respect to one or more of the relevant listed items.

Spatial relative terms "inside", "outside", "back", "bottom", "low", "top", "high", etc. are used herein to facilitate the description that describes relationships between one element or feature and other element(s) or feature(s). Spatial relative terms may be understood to include different orientations of a device in use or operation, in addition to the orientations depicted in the drawings. For example, when the device in the drawing is flipped over, an element described as "below" or "directly below" another element or feature is then positioned "above" the other element or feature. Therefore, the term "below" can include both above and below. The device may be oriented in the other direction (e.g., rotated by 90 degrees or in any other direction) and the spatially relative terms used herein are interpreted accordingly.

What is claimed is:

1. A wireless communication device comprising:
- a substrate containing a dielectric;
- a zeroth-order resonance antenna;
- a high frequency circuit mounted on the substrate; and
- a metal body mounted on the substrate, wherein
- the zeroth-order resonance antenna includes:
  - a main plate arranged on a bottom surface of the substrate and providing a ground potential;
  - a patch portion arranged on a top surface of the substrate and including a feeding point;
  - a feeder line extending from the feeding point of the patch portion to electrically connect the patch portion and the high frequency circuit, at least a part of the feeder line being arranged on the top surface of the substrate; and
  - a short circuit portion arranged in the substrate and electrically connecting the patch portion and the main plate, and
- the metal body is configured to
  - have a same potential as the main plate,
  - have a metal body height greater than a patch portion height,
  - and
  - in a plan view, be arranged (i) at least partially within a range of a width of the feeder line seen from an alignment direction of a center of the patch portion and the feeding point, and (ii) at least partially within an in-between region between the patch portion and the high frequency circuit, wherein,
- a wavelength of a radio wave in an operating frequency of the zeroth-order resonance antenna is $\lambda$, and
- a distance of D between the patch portion and the metal body satisfies a relationship of $0<D<\lambda\times 1/2$ in the plan view,
- whereby directivity of the zeroth-order resonance antenna is different from an extension direction of the feeder line.

2. The wireless communication device of claim 1, wherein
- the feeder line has a straight portion extending in a straight line shape from the feeding point on the same surface as the patch portion,
- the metal body is arranged directly above the straight line portion or on an extension line of the straight line portion.

3. The wireless communication device of claim 1, wherein
- the patch portion is arranged in a vicinity of an outer peripheral edge of the substrate.

4. The wireless communication device of claim 1, wherein the metal body is mounted on top surface of the substrate.

5. The wireless communication device of claim 4, wherein the patch portion and at least a part of the feeder line are arranged on the top surface of the substrate, and the metal body projects upward more than the patch portion from the top surface of the substrate.

6. The wireless communication device of claim 1, wherein the metal body is a shield case that protects the high frequency circuit.

7. A wireless communication device comprising:

a substrate;

a main plate located on a bottom surface of the substrate;

a patch portion: (ii) located on a top surface of the substrate, (ii) including a center of the patch portion, and (iii) including a feeding point located at a first edge of the patch portion;

a short circuit portion located in the substrate and electrically connecting the main plate to the center of the patch portion;

a high frequency circuit;

a feeder line electrically connecting the feeding point to the high frequency circuit; and a metal body including a first wall portion at least partially located between the patch portion and the high frequency circuit, wherein:

the feeder line includes, in electrical series:

(i) a first portion extending orthogonally in a Y-direction from the first edge of the patch portion towards the high frequency circuit;

(ii) a second portion extending in a Z-direction towards an edge of the substrate;

(iii) a third portion extending in the Y-direction; and (iv) a fourth portion extending in a negative Z-direction and contacting a second edge of the high frequency circuit, and the metal body includes, in a plan view, a first wall portion: (i) extending in a Z-direction and NOT crossing over the feeder line, and (ii) located between the patch portion and the high frequency circuit.

8. The wireless communication device of claim 7, wherein:

the feeder line extends orthogonally in a Y-direction from the first edge of the patch portion to a center portion of a first edge of the high frequency circuit, the metal body includes, in a plan view, a first wall portion: (i) extending in a Z-direction over the feeder line, and (ii) located between the patch portion and the high frequency circuit relative to the Y-direction.

9. The wireless communication device of claim 7, wherein:

the metal body substantially encloses a top of the high frequency circuit and all sides of the high frequency circuit, the patch portion, the feeder line, and the metal body all fully overlap the main plate in a plan view.

10. The wireless communication device of claim 7, wherein, in a plan view:

the patch portion is substantially a first rectangle including four patch portion sides, each of the patch portion sides is parallel with the Z-direction or parallel with the Y-direction, the metal body is substantially a second rectangle including four metal body sides, each of the metal body sides is parallel with the Z-direction or parallel with the Y-direction, the metal body is offset from the patch portion in the Y-direction, and the third portion of the feeder line is offset from the metal body in the Z-direction, such that a first distance from the third portion of the feeder line to an end portion of the substrate is less than a second distance from the metal body to the end portion.

11. The wireless communication device of claim 1, wherein:

the feeder line includes, in electrical series:

(i) a first portion extending orthogonally in a Y-direction from a first edge of the patch portion towards the high frequency circuit;

(ii) a second portion extending in a Z-direction towards an edge of the substrate;

(iii) a third portion extending in the Y-direction; and (iv) a fourth portion extending in a negative Z-direction and contacting a second edge of the high frequency circuit.

12. The wireless communication device of claim 1, wherein:

the metal body includes, in a plan view, a first wall portion: (i) extending in a Z-direction and NOT crossing over the feeder line, and (ii) located between the patch portion and the high frequency circuit.

13. The wireless communication device of claim 1, wherein the distance of D satisfies a relationship of $D=\lambda\times 1/4$ in the plan view.

* * * * *